US011371801B2

(12) United States Patent
Shinkle et al.

(10) Patent No.: US 11,371,801 B2
(45) Date of Patent: Jun. 28, 2022

(54) FIREARM BRACE

(71) Applicant: Sig Sauer, Inc., Newington, NH (US)

(72) Inventors: Scott D. Shinkle, Greenland, NH (US); Christopher Baker, Milton, MA (US); Wayne Wilson, Dover, NH (US); Harry Andrew Packard, Amesbury, MA (US); Sean Kennedy, Barrington, NH (US); Luke Edward Morenz, Dover, NH (US); Christopher Brent D'Alfonso, Exeter, NH (US)

(73) Assignee: Sig Sauer, Inc., Newington, NH (US)

( * ) Notice: Subject to any disclaimer, the term of this patent is extended or adjusted under 35 U.S.C. 154(b) by 0 days.

(21) Appl. No.: 17/332,091

(22) Filed: May 27, 2021

(65) Prior Publication Data

US 2021/0372731 A1 Dec. 2, 2021

Related U.S. Application Data

(60) Provisional application No. 63/032,975, filed on Jun. 1, 2020.

(51) Int. Cl.

| | |
|---|---|
| ***F41C 23/12*** | (2006.01) |
| ***F41C 23/14*** | (2006.01) |
| *F41C 23/22* | (2006.01) |

(52) U.S. Cl.
CPC ..... *F41C 23/14* (2013.01); *F41C 23/22* (2013.01)

(58) Field of Classification Search
CPC ..... F41C 23/12; F41C 23/04; F41C 23/14
See application file for complete search history.

(56) References Cited

U.S. PATENT DOCUMENTS

| | | | | |
|---|---|---|---|---|
| 9,664,477 | B1 * | 5/2017 | Reavis, III | F41A 23/02 |
| 2019/0017777 | A1 * | 1/2019 | Wilson | F41C 33/001 |
| 2021/0172703 | A1 * | 6/2021 | Tippmann, Jr. | F41C 23/14 |
| 2021/0239423 | A1 * | 8/2021 | Liptak | F41C 23/02 |

* cited by examiner

*Primary Examiner* — J. Woodrow Eldred
(74) *Attorney, Agent, or Firm* — Finch & Maloney PLLC

(57) ABSTRACT

A brace assembly is configured for use with a longitudinal support of a firearm, such as a cylindrical bar or receiver extension. The assembly includes a brace body with a first or lower body member and a second or upper body member. The body members are configured to engage opposite surfaces of the longitudinal support. A brace portion can be attached to the brace body. In one example, a mounting post extends rearwardly from the brace body and the brace portion includes left and right brace members each having an upper end portion configured to attach to and pivot about the mounting post.

20 Claims, 18 Drawing Sheets

FIREARM BRACE

BACKGROUND

The present disclosure relates generally to firearm braces and their components, and more specifically to an improved brace for pistols and other firearms.

Firearm design involves many non-trivial challenges, including the design of grips and stocks to facilitate the user in having a stable position for discharging the firearm. Some considerations related to the design of firearms address a stock, brace, or other feature that aids the user in stabilizing the firearm during use, such as the length of pull, height of the comb, and adjustability, to name a few examples.

SUMMARY

The embodiments described in the present disclosure relate to a brace for use with a firearm, such as pistols based on the AR-15 platform, pistol-caliber carbines, submachine guns, and short-barreled rifles. In accordance with some embodiments, the brace is configured to engage the user's forearm to stabilize the firearm during use. For example, the brace assembly includes a brace body that has a first body member and a second body member, where the first and second body members frictionally engage opposite sides of a longitudinal support of a firearm, such as the top and bottom sides of a receiver extension (or "buffer tube"), or like structure, to securely attach the brace assembly to the firearm.

In accordance with other embodiments, a longitudinal support is part of the brace assembly, where the distal end of the longitudinal support can be secured to the firearm with a locking hinge. In one such embodiment, the longitudinal support is a beam having an oval, round, or rectangular cross-sectional shape. The proximal end of the longitudinal support includes an axially extending cylindrical post to which first and second brace plates are attached. For example, the upper end portion of each brace plate defines a circular opening sized to receive the post. Each brace plate can pivot about the post independently of the other brace plate. In some embodiments, the post includes a key and one or both brace flaps has a corresponding keyway in the circular opening, or vice versa. The key functions as a stop to limit the range of rotational movement about the post. In one such embodiment, each brace plate can pivot about the post up to 45° with respect to a median plane, providing up to a 90° sector region between the brace plates where the user's forearm is received.

Further aspects, advantages and areas of applicability will become apparent from the description provided herein. It should be understood that the description and specific examples are intended for purposes of illustration only and are not intended to limit the scope of the present disclosure.

Figure 1:
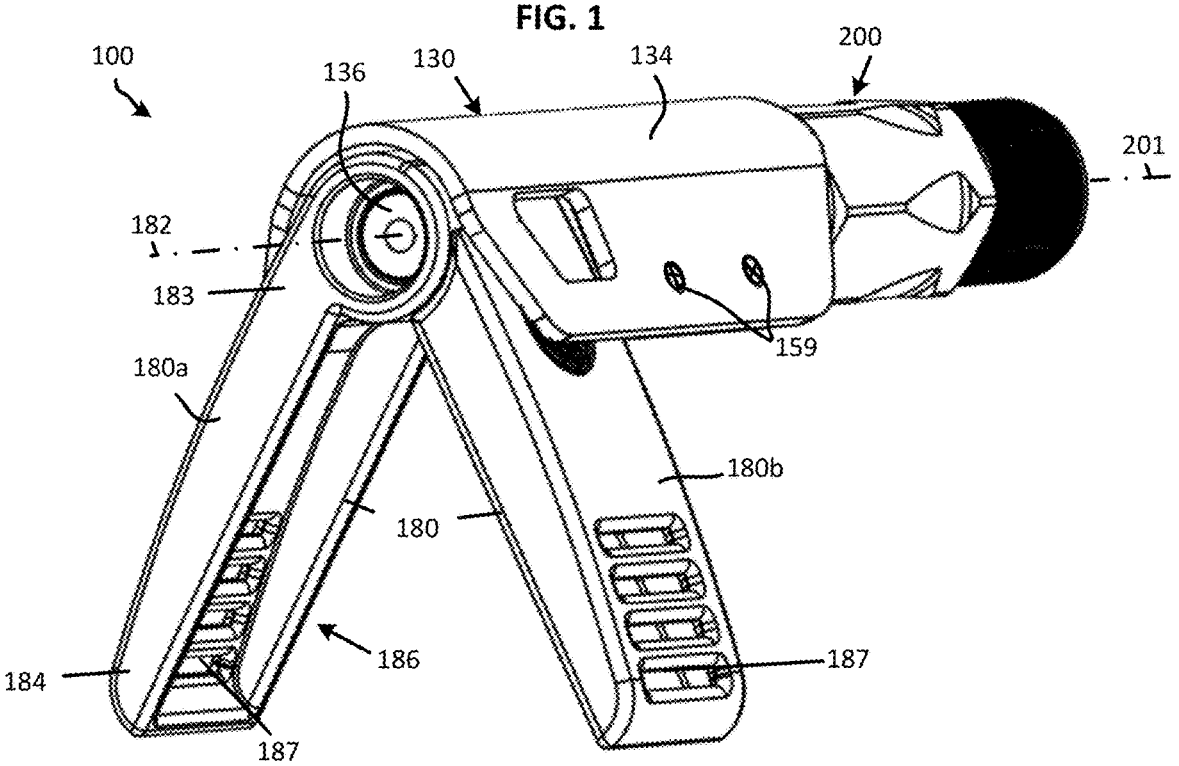
FIG. 1 illustrates a rear perspective view of brace assembly and longitudinal support with brace plates in an open position, in accordance with an embodiment of the present disclosure.

The figures depict various embodiments of the present disclosure for purposes of illustration only. Numerous variations, configurations, and other embodiments will be apparent from the following detailed discussion.

DETAILED DESCRIPTION

Disclosed is a brace assembly for use with a firearm. In accordance with some embodiments of the present disclosure, a brace is configured to mount to a longitudinal support extending from the firearm, such as a receiver extension, and includes one or more brace members configured to engage the user's forearm during use. For example, the receiver extension can be a traditional buffer tube as used on M4-type rifles, where the buffer tube has a cylindrical tube that includes a rectangular ridge or flange protruding from and extending along the bottom of the tube. Buffer tubes and cylindrical supports may include a threaded end portion that screws into the lower receiver. In another example, the longitudinal support is a beam or the like attached to the firearm, where the beam has a cross-sectional shape of a rectangle, a rectangle with rounded top and bottom sides, a diamond, a square, an I-shape, an oval, or other cross-sectional shape.

In accordance with one embodiment, the brace assembly includes a brace body that includes a first or lower body member and a second or upper body member. The first and second body members are configured to be fastened together to tightly engage opposite surfaces of the longitudinal support. For example, the first and second body members engage opposite lateral sides, or opposite top and bottom sides, of the longitudinal support. A forearm support, brace, or buttstock is attached or can be attached to the brace body. Although the brace assembly is described herein as having lower and upper body members to facilitate discussion, it is contemplated that the first and second body members can engage two or more suitable surfaces of the longitudinal support.

In one example, the first body member is a lower body member having a base that defines a recess to receive the longitudinal support, such as a cylindrical tube. The second body member is an upper body member having a domed upper portion and generally planar side portions that extend downward and outward from the upper portion. In one example, the recess is concave and sized to engage a cylindrical tube or the like. In another example, the concave recess further defines a slot intersecting a lower portion of the recess, so that the recess is shaped to receive a buffer tube having a bottom flange.

In some embodiments, a mounting post extends rearwardly from the brace body, such as from a vertical rear wall on the lower body member or from a similar structure on the upper body member. The mounting post can be concentric with the longitudinal support, or can be positioned above, below, right or left of the centerline of the longitudinal support. The brace member can be one or more of a blade, a plate, a hook, a strap, a buttstock, or a forearm brace assembly that is mounted to the mounting post. In one example, the brace portion includes left and right brace plates that extend down from the brace body can pivot independently of one other between an open position and a closed position. An adjustable strap can be attached to the lower end portion of each brace plate to form a closed loop with the brace plates and brace body. When the user's arm is positioned between the brace plates, the strap can be tightened around the arm to draw the brace plates tightly to the user's arm and stabilize the firearm for use.

When installed on a receiver extension, tube, or the like, the first and second body members can be drawn towards each other to frictionally engage the opposite surfaces of the longitudinal support and secure the brace assembly to the longitudinal support. In one example, one or more fasteners extend between the first and second body members so that tightening the fasteners draws together the body members, and in turn snugly engages the longitudinal support with a clamping action. The clamping action results in a frictional engagement sufficient to stabilize the brace assembly on cylindrical longitudinal support during use of the firearm.

In some embodiments, the first and second body members include interlocking structures that can be used in part to maintain the upper and lower body portions connected to one another and to retain the brace assembly on the longitudinal support. In one embodiment having upper and lower body members, the upper body member can slidingly engage the lower body member with portions of the upper body member overlapping corresponding surfaces on the lower body member. For example, sides of the lower body member define an overhang or catch surface along the length of the body. An L-shaped shelf extends inward from the bottom of side portions of the upper body member so as to define an upward directed hook. The upper body member can be slidingly installed onto the lower body member so that the L-shaped shelf interlocks with the overhang. In some embodiments, fasteners between the lower body member and the longitudinal support can further tension the assembly to reduce any play in the assembly and/or to enhance the frictional engagement with the longitudinal support. Numerous variations and embodiments will be apparent in light of the present disclosure.

In accordance with another embodiment of the present disclosure, a brace assembly is configured to attach to the rear end of a firearm receiver or frame. The brace assembly has a longitudinal support, such as a tube or beam, that can be attached to the firearm and extend rearwardly along a median plane of the pistol. Brace members, such as a first plate and a second plate, are pivotably attached to a mounting post on the proximal end of the longitudinal support. The first brace plate has a first plate upper end portion and a first plate body, where the first plate upper end portion defines an opening for pivoting about the post. Similarly, the second brace plate has a second plate upper end portion and a second plate body, where the second plate upper end portion defines an opening for pivoting about the post. In a closed position, the first and second brace plates extend downward from the post in opposed alignment. A flexible strap can be connected to the first plate lower end portion and the second plate lower end portion. When the brace plates are in an open position, the brace defines a forearm passageway sized to receive a forearm of a user. The flexible strap can be tightened around the forearm to secure the brace to the user.

The mounting post can include a key or stop that limits the rotational movement of one or both brace plates. The opening in the upper end portion of one or both brace plates can define a keyway that corresponds to the key on the mounting post. The keyway can be sized to define the limits of rotation. Alternately, the key can be a protrusion from the opening in the upper end portion of one or both brace plates and the keyway is defined in the mounting post. In one example, each brace plate can rotate from a closed position aligned with the median plane to an open position. In one such embodiment, each brace plate 180 can be rotated 20° to 90° away from the median plane, including 20° to 60° and 20° to 40° from the median plane.

In some embodiments, one or both of the first plate and the second plate has a fixed position relative to the median plane. For example, the fixed position is releasable. In one embodiment, the fixed position is a closed position with a first inside surface of the first plate facing and closely adjacent a second inside surface of the second plate.

In some embodiments, the brace optionally includes a mounting bracket attached to the distal end of the longitudinal support and configured to engage the frame of the pistol. In one embodiment, the mounting bracket is configured to engage a mounting rail on the rear end of the pistol, such as a MIL-STD 1913 rail or "Picatinny" rail. In another embodiment, the mounting bracket is a hinge with one hinge leaf that can be attached to the firearm and a second hinge leaf that attaches to the longitudinal support.

Numerous variations and embodiments will be apparent in light of the following example embodiments.

General Overview

Existing firearm braces are made of a soft rubber and include an upper portion that defines a cylindrical passage extending longitudinally therein. The passage telescopically receives the buffer tube or other tubular support structure. The lower portion of the attachment body is longitudinally bifurcated with downwardly-depending opposed flaps to receive and grip the user's forearm along the buffer tube. The flaps are laterally spaced and form a gap to receive the forearm of a user. The attachment may have a strap that encircles the flaps and the user's forearm, so that the strap can be cinched tight to secure the attachment to the user's forearm. The firearm stabilizing attachment maintains the user's forearm positioned below and extending along the buffer tube or other support structure. A deficiency of such a firearm brace is that the flaps have little or no adjustment and the brace requires the user's arm to have a position that conflicts with proper sight alignment of conventional shooting positions. Also, being made of a relatively soft rubber-like material, the brace flaps lack the structural integrity to adequately support the firearm.

Another existing brace assembly has an adjustable locking mechanism. The clearance requirements of the locking mechanism undesirably permits excess movement and noise. Yet another brace assembly has a press-fit assembly that is difficult to install or remove. In other assemblies, the brace is a blade-like structure that provides lateral stability, but little or no vertical support. Due to the shortcomings of existing firearm braces, a need exists for improvements. The present disclosure addresses this need and others.

In accordance with some embodiments of the present disclosure, a brace assembly can be configured to readily attach to a traditional buffer tube or receiver extension, has interlocking components for ease of installation and removal, has an ergonomic contour for more comfortable shooting, and/or can be securely mounted to a tubular structure to eliminate or greatly reduce excess movement between components.

In accordance with some embodiments, brace plates are mounted to a mounting post and are independently rotatable about the mounting post between a closed position and an open position. The mounting post can include a key or like structure to limit rotation of one or both brace plates due to a corresponding keyway in the opening of the brace plate, or vice versa.

As will be appreciated in light of this disclosure, and in accordance with some embodiments, a brace configured as described herein can be utilized with any of a wide range of host firearms, such as, but not limited to, a pistol, a submachine gun, a carbine, and a short-barreled rifle. An example of one suitable pistol is the SIG MPX® Pistol by Sig Sauer, Inc., a semiautomatic pistol chambered in 9 mm Luger with an eight-inch barrel and an overall length of about seventeen inches. Other suitable host firearms and projectile calibers will be apparent in light of this disclosure.

Also, it should be noted that, while generally referred to herein as a brace assembly for consistency and ease of understanding the present disclosure, the disclosed brace assembly is not limited to that specific terminology and alternatively can be referred to, for example, as a forearm brace, a stabilizing attachment, a forearm pistol brace, a pistol contour brace, or other terms. Similarly, while generally referred to as brace plates, the disclosed brace plates could alternately be referred to as brace members, bolster plates, paddles, or other term. As will be further appreciated, the particular configuration (e.g., materials, dimensions, etc.) of a brace assembly configured as described herein may be varied, for example, depending on whether the intended use is military, tactical, law enforcement, or civilian in nature. Numerous configurations and advantages will be apparent in light of this disclosure.

Example Structures

Figure 2:
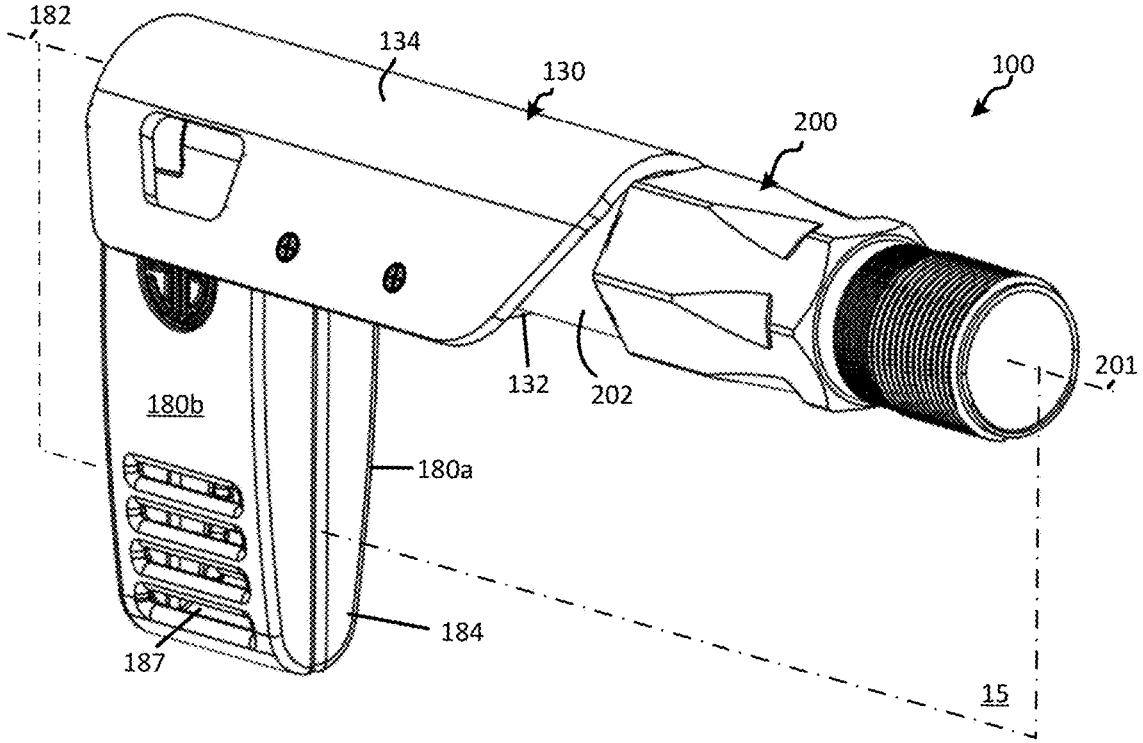
FIG. 2 illustrates a front perspective view of a brace assembly and longitudinal support with the brace plates in a closed position, in accordance with an embodiment of the present disclosure.
Figure 3:
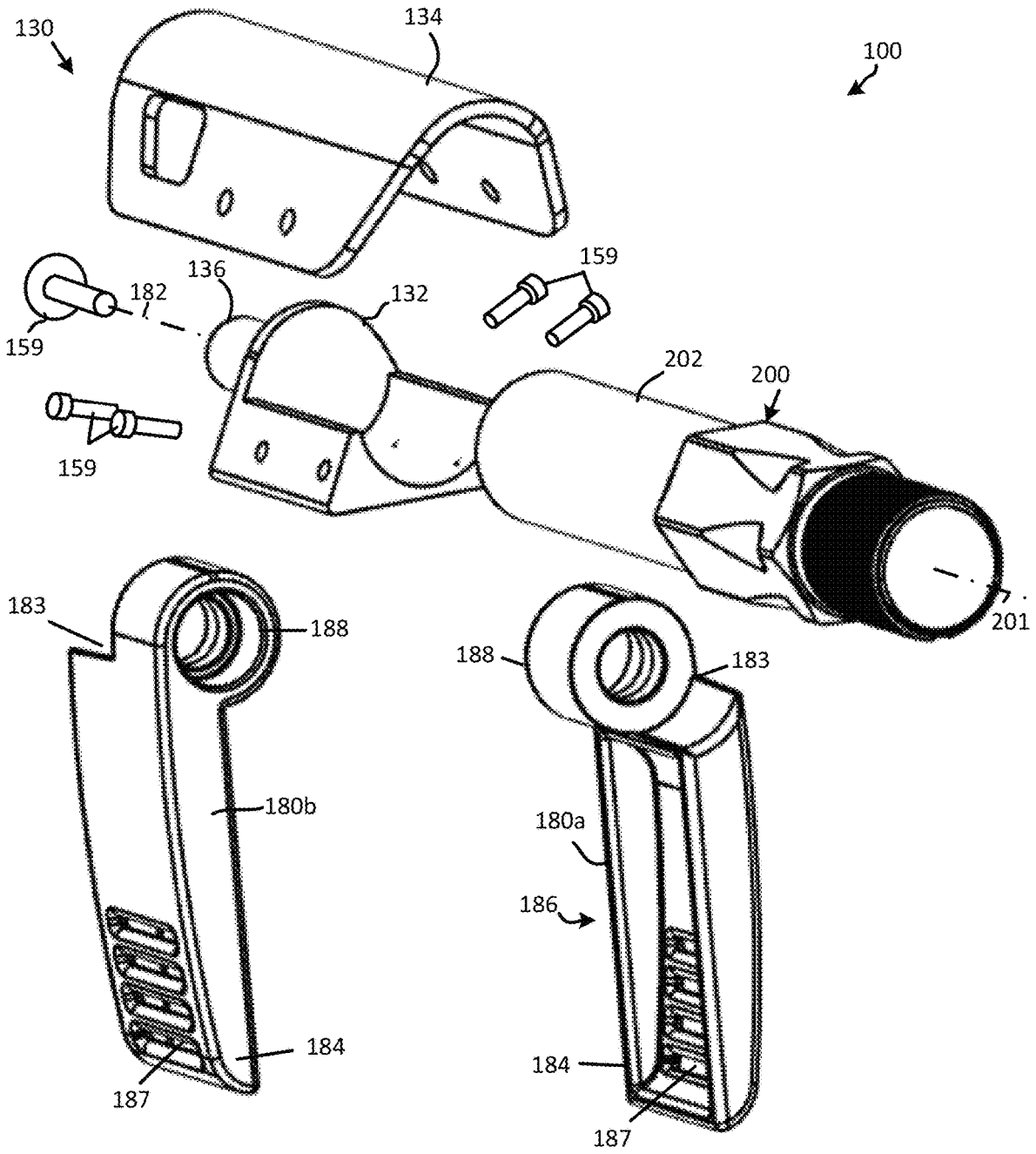
FIG. 3 illustrates an exploded front perspective view of a brace assembly and longitudinal support, in accordance with an embodiment of the present disclosure.

Referring to FIGS. 1-3, rear and front perspective views show a brace assembly 100 mounted to a longitudinal support 200 of a firearm, in accordance with an embodiment of the present disclosure. FIG. 1 illustrates a rear perspective view of brace assembly 100 and longitudinal support 200 with brace plates 180 in an open position. FIG. 2 illustrates a front perspective view of brace assembly 100 and longitudinal support 200 with brace plates 180 in a closed position. FIG. 3 illustrates an exploded front perspective view of brace assembly 100 and longitudinal support 200. FIGS. 1-3 are described concurrently below.

Brace assembly 100 includes a two-part brace body 130 that can be attached to the longitudinal support 200 of a firearm, such as a buffer tube or the like. The brace body 130 includes a first or lower body member 132 (visible in FIG. 3) and a second or upper body member 134. The lower and upper body members 132, 134 are configured to assemble with one another and engage opposite surfaces of the longitudinal support 200. For example, the lower body member 132 and upper body member 134 include mating surfaces that can be drawn together with fasteners 159 extending between the body members. As the fastener(s) 159 are tightened, the lower and upper body members 132, 134 clamp a longitudinal support 200, such as a cylindrical portion 202 thereof.

A first or left brace plate 180*a* and a second or right brace plate 180*b* (collectively, brace plates 180) are pivotably attached to the brace body 130, such as to a mounting post 136 extending rearwardly from a rear wall 146 of the lower body member 132. In other embodiments, the mounting post 136 is on the upper body member 134. The brace plates 180 each have an upper end portion 183 and a lower end portion 184, where the upper end portion 183 is pivotably attached to the mounting post 136. When installed on mounting post 136, such as shown in FIG. 1, brace plates 180 extend down from the mounting post 136 in opposed alignment and can rotate or pivot between an open position (e.g., shown in FIG. 1) and a closed position (e.g., shown in FIG. 2). In one embodiment, first brace plate 180*a* and second brace plate 180*b* can pivot independently of each other about a single mounting post 136, and therefore about a common pivot axis 182. For example, in one embodiment the pivot axis 182 is coincident with a central axis 201 of longitudinal support 200; in other embodiments, pivot axis 182 can be offset vertically, horizontally, or both with respect to the central axis 201 of longitudinal support 200. In other embodiments, each brace plate 180 is attached to and can pivot about its own pivot axis, such as when the brace body 130 includes a mounting post 136 for each brace plate 180. In the open position, such as shown in FIG. 1, one or both of first brace plate 180*a* and second brace plate 180*b* may pivot away from a median plane 15 extending vertically through longitudinal support 200. In the closed position, first brace plate 180*a* and second brace plate 180*b* confront each other and are closely adjacent or abut one another.

In one embodiment, brace plates 180 are symmetrical with each other about to the median plane 15. In other embodiments, the first brace plate 180*a* can have a different geometry compared to second brace plate 180*b*, such as having a difference in one or more of curvature, axial length, vertical length, thickness, stiffness, placement of strap openings 187, or other trait. When brace assembly 100 is in the closed position, such as shown in FIG. 2, brace plates 180 are positioned against one another in a face-to-face orientation with inside portions facing each other. In the example shown, each upper end portion 183 includes a hinge knuckle 188 with a cylindrical opening configured to receive the mounting post. The hinge knuckle 188 can be axially offset from the remainder of the brace plate 180 towards a front or rear portion so that the hinge knuckles 188 can be axially aligned when installed onto a common mounting post 136, which functions like a hinge pin. In some embodiments, one or both the brace plates 180 can include more than one hinge knuckle 188 so that the hinge knuckles 188 are interleaved when both brace plates 180 are assembled onto the mounting post 136.

In some embodiments, one or both brace plates 180 are hollow or otherwise define a cavity or strap recess 186. For example, the strap recess 186 is sized to accommodate the flexible strap 250 in a folded configuration (shown, e.g., in FIG. 8) when brace assembly 100 is in the closed position. In some embodiments, the lower end portion 184 of each brace plate 180 defines one or more strap openings 187 configured to receive strap 250 therethrough. In one example, flexible strap 250 can be a length of nylon webbing that is threaded through strap openings 187 to define a closed loop. The strap 250 can be tightened or adjusted to draw the brace assembly 100 tight to the forearm of the user.

Figure 13:
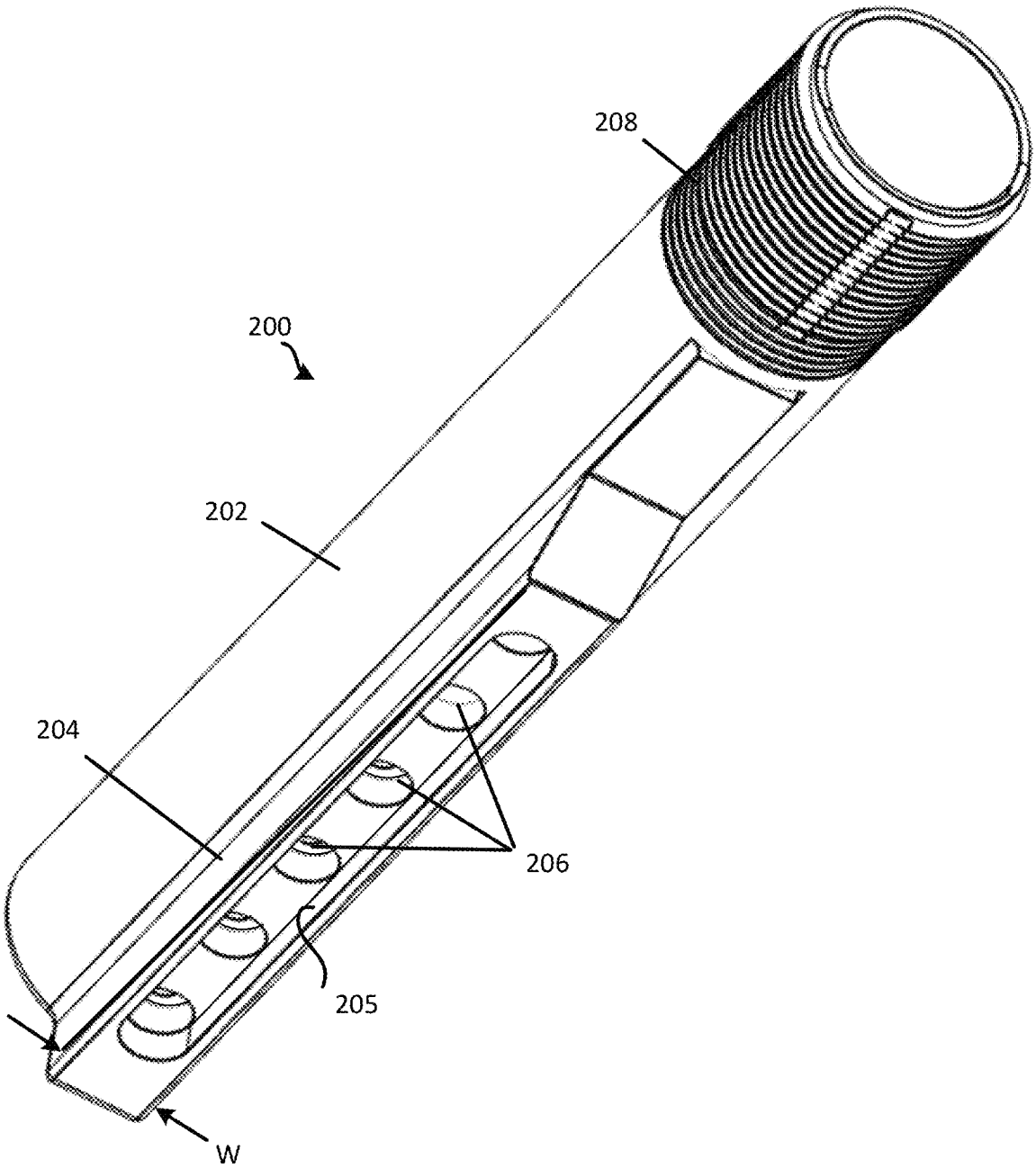
FIG. 13 illustrates a bottom and front perspective view of a longitudinal support configured for threaded engagement with a firearm receiver, in accordance with an embodiment of the present disclosure.

Longitudinal support 200 can have any one of a variety of configurations. In one example, longitudinal support 200 includes a cylindrical portion 202, where the longitudinal support 200 can be mounted to a firearm receiver, such as by threaded engagement into the lower receiver. In another example, the longitudinal support 200 is a mil-spec buffer tube as commonly used with M4 rifles and the like. As illustrated in FIG. 13, for example, such buffer tubes include a cylindrical portion 202 with a flange 204 or ridge of rectangular cross-sectional shape protruding from and extending along its bottom surface. The flange 204 includes recesses to lock an adjustable stock in one of a plurality of positions. In another embodiment, longitudinal support 200 has a beam-like construction with a generally rectangular cross-sectional shape or other suitable cross-sectional shape. For example, the cross-sectional shape can be a square or rectangle with rounded top and bottom. Optionally, longitudinal support 200 defines one or more openings extending transversely therethrough to reduce weight and/or to accommodate a sling mount or strap, as will be appreciated.

Figure 4A:
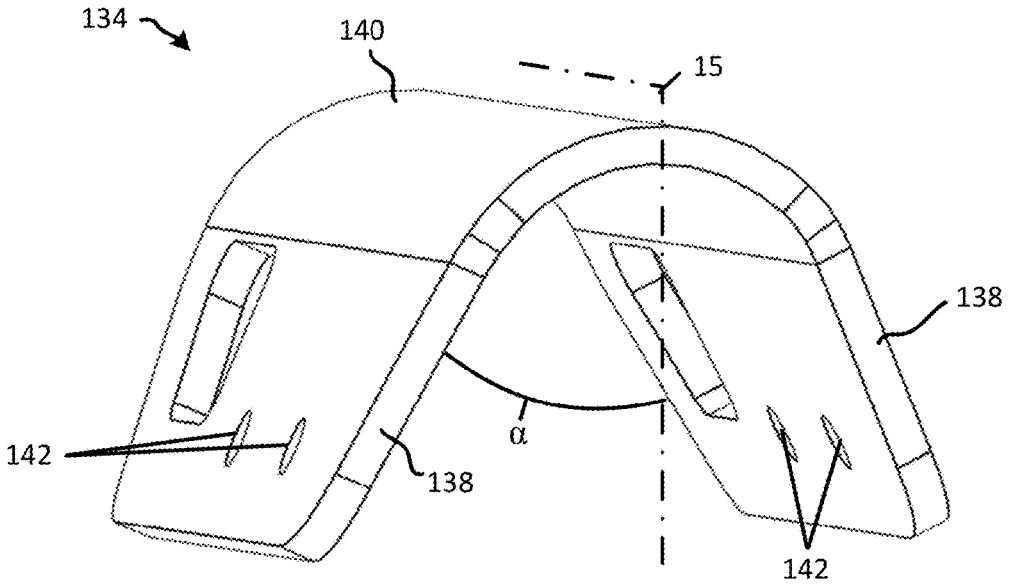
FIGS. 4A and 4B illustrate a front perspective view and a side view, respectively, of an upper body member, in accordance with an embodiment of the present disclosure.
Figure 4B:
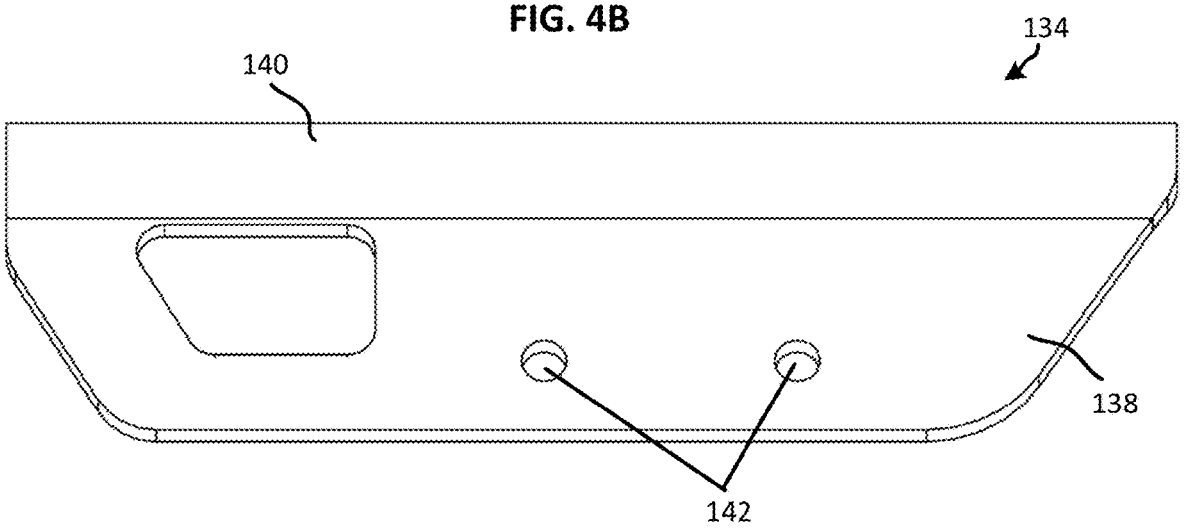

Referring now to FIGS. 4A and 4B, a front perspective view and a side view, respectively, illustrate upper body member 134, in accordance with an embodiment of the present disclosure. In this example, upper body member 134 has a domed shape with side portions 138 extending down from an arcuate top portion 140, where the side portions 138 are generally planar. The top portion 140 is shaped to mate with the longitudinal support 200, which has a cylindrical shape in some embodiments. In addition to a rounded shape, the top portion 140 alternately can be planar, have a V shape, or some other geometry that is suitable to engage the longitudinal support 200. In some such embodiments, the top portion 140 is part of a cylinder sized equal to or slightly larger than the cylindrical longitudinal support 200 so as to overlap and contact the longitudinal support 200 along its top surface. In some embodiments, each side portion 138 defines an angle $\alpha$ with the median plane 15 of from 0-60°, including 10-30°, 20-45°, 20-30°, and about 25°. Each side portion 138 defines one or more fastener openings 142 for fasteners 159.

Figure 5A:
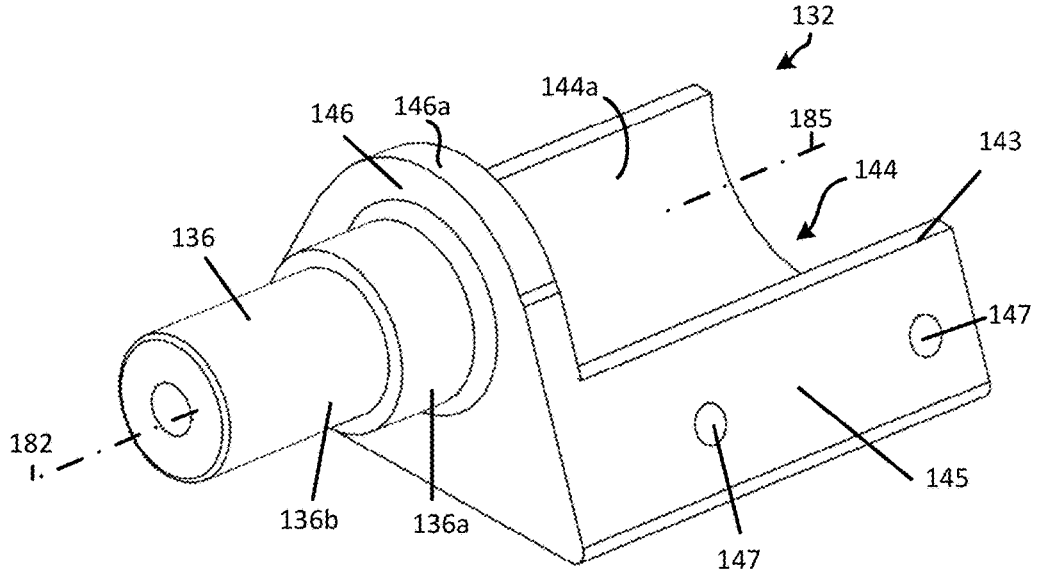
FIGS. 5A and 5B illustrate a rear perspective view and a side view, respectively, of a lower body member, in accordance with an embodiment of the present disclosure.
Figure 5B:
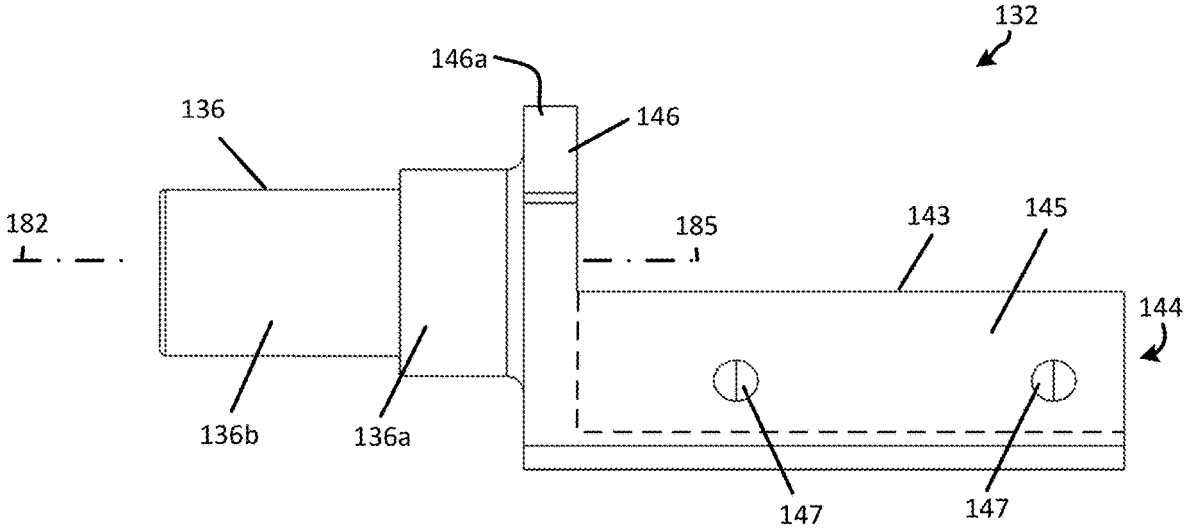

Referring now to FIGS. 5A and 5B, a top, rear, and side perspective view and a side elevational view, respectively, illustrate lower body member 132, in accordance with an embodiment of the present disclosure. In this embodiment, the lower body member 132 includes a base 143 defining a recess 144 or pocket having a curved inside surface 144*a*. The recess 144 is shaped and configured to engage the bottom of a longitudinal support 200 having a corresponding shape (e.g., cylindrical). In this example, the recess 144 is semicircular and is sized to contact the outside of a cylindrical portion 202 of a longitudinal support 200, but it could similarly receive a longitudinal support 200 of other geometry. For example, the longitudinal support 200 could be a beam having a cross-sectional shape of a rectangle with rounded top and bottom surfaces, where the radius of curvature is the substantially the same as that of the recess 144.

The base 143 also includes opposite outer side surfaces 145 that extend downward and outward with respect to a central axis 185 of the recess 144, which is coincident with the pivot axis 182 in this example. The base 143 defines a plurality of fastener bores 147 extending into opposite outer side surfaces 145 in a generally downward and inward direction. In some embodiments, the fastener bores 147 are perpendicular to the outer side surface 145. As such, when angle $\alpha$ of each side portion 138 is 25° with respect to the vertical (shown in FIG. 4A), fasteners extend in a downward direction into the lower body member 132 at an angle of 25° to the horizontal, and therefore at least in part draw the lower body member 132 and upper body member 134 vertically towards each other to more tightly engage the longitudinal support 200. In doing so, the lower body member 132 is tensioned about the bottom of the longitudinal support 200 and the upper body member 134 is tensioned about the top of the longitudinal support 200.

A rear wall 146 connects to the rear end of the base 143 and extends vertically upward. The rear wall 146 provides a stop surface for the longitudinal support 200. As shown in this example, the laterally outside faces 146*a* of the rear wall 146 can be continuous with the outer side surfaces 145 and have a shape corresponding to the inside of the upper body member 134 (shown in FIGS. 4A-4B). The mounting post 136 is connected to and extends rearward from the rear wall 146 along the pivot axis 182. The mounting post 136 has a region of first diameter 136*a* and a region of a second diameter 136*b*, where the region of second diameter 136*b* is of a different size (e.g., smaller) compared to the region of first diameter 136*a*. In other embodiments, the mounting post 136 has a consistent diameter along its length. In this example, the mounting post 136, base 143, and rear wall 146 are parts of a single monolithic lower body member 132. In other embodiments, some or all of these can be separate components that are assembled, for example, using fasteners, threaded connections, or welding.

Figure 5C:
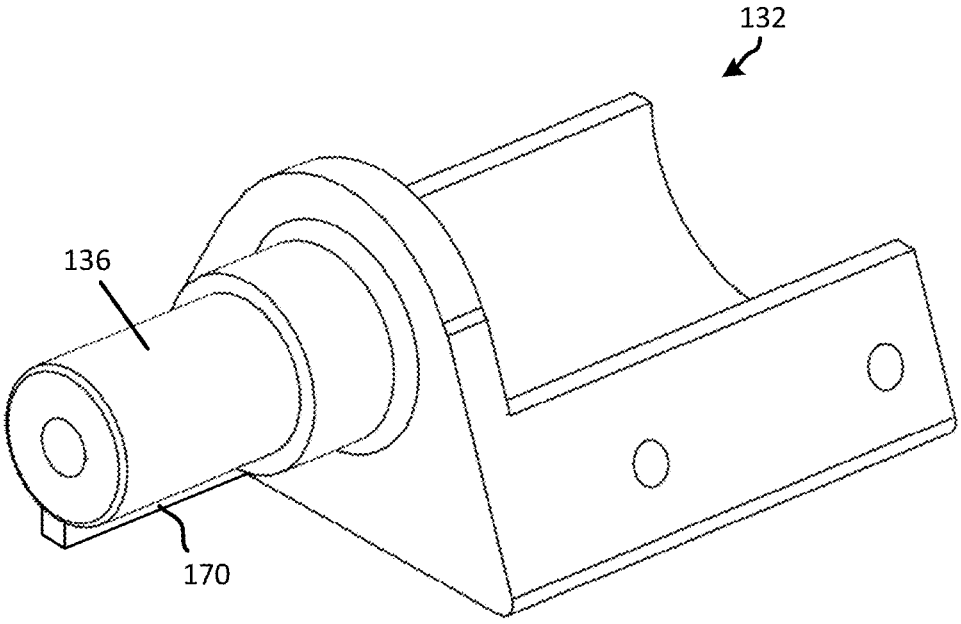
FIGS. 5C and 5D illustrate a rear perspective view and a side view, respectively, of a lower body member with a key on the mounting post, in accordance with an embodiment of the present disclosure.
Figure 5D:
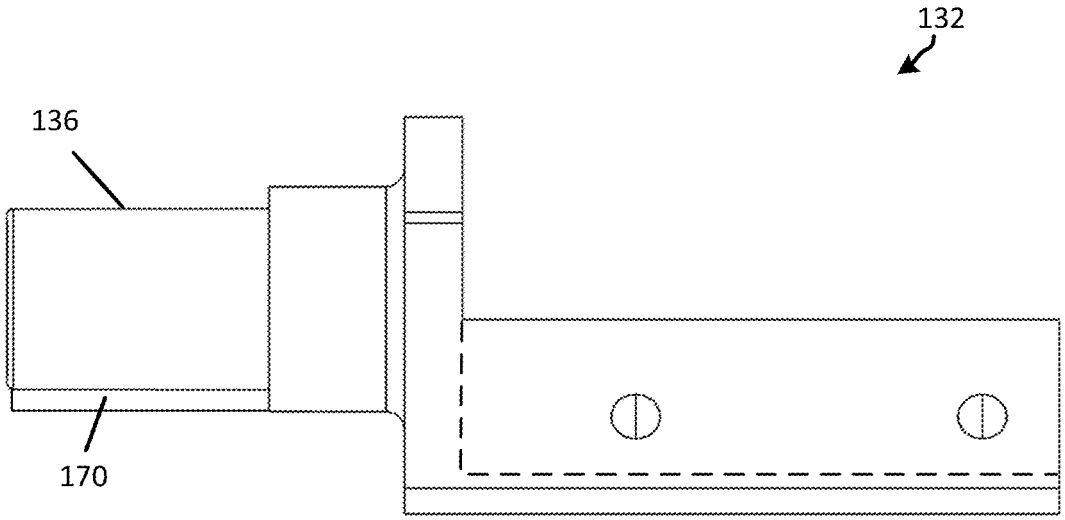

FIGS. 5C and 5D illustrate a variation on the lower body member 132 shown in FIGS. 5A-5B. Many features of the lower body member 132 are consistent with the embodiments of FIGS. 5A-5B. One difference of this embodiment is that the mounting post 136 includes a protrusion or key 170 that extends radially outward. The key 170 is illustrated as extending downward from the bottom surface of the mounting post 136, although other locations for the key 170 are acceptable. The key 170 can be integrally formed as part of the mounting post 136, or the key 170 may be a separate component that is attached to the mounting post 136 by welding, fasteners, or other suitable method. The key 170 functions as a stop to limit the range of rotational motion of one or both brace plates 180. A corresponding keyway 192 in the opening 190 of the brace plates 180 is discussed in more detail below. In other embodiments, the key 170 and keyway 192 are reversed, such as the keyway 192 being defined in the mounting post 136 and the key 170 protruding from an inside surface of the opening in the upper end portion of the brace plate.

Figure 6A:
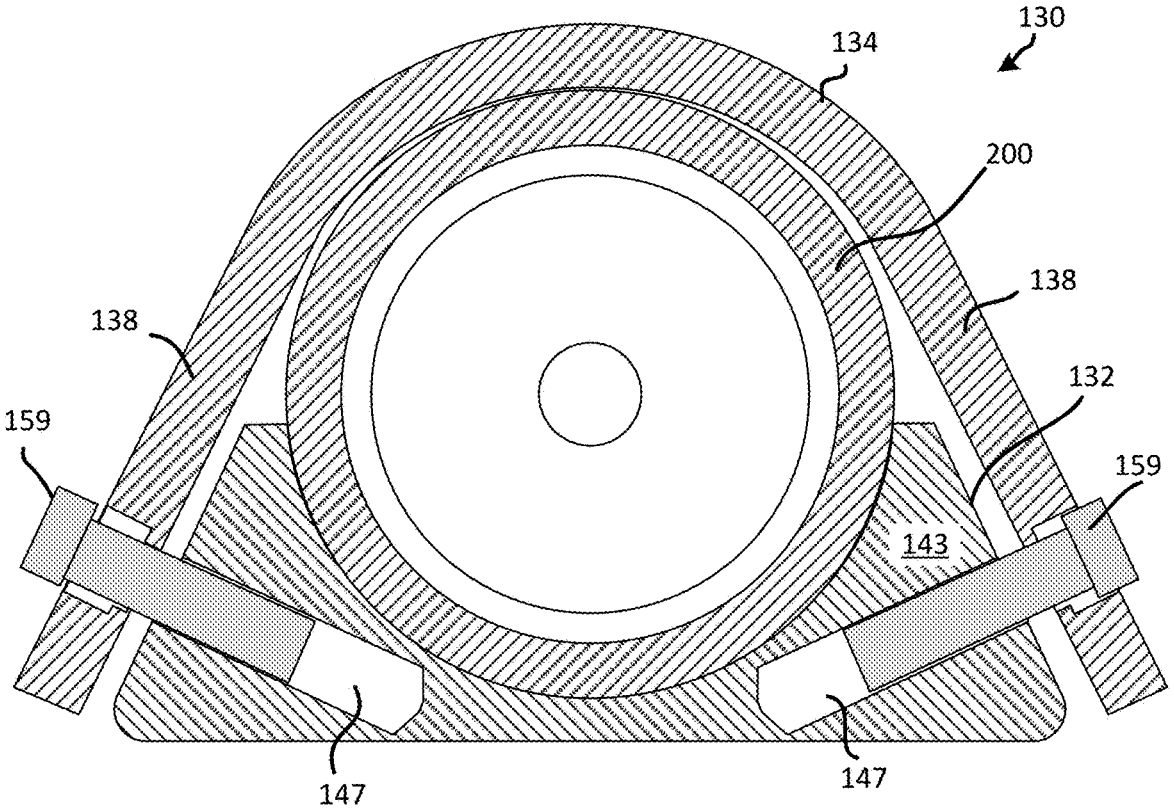
FIGS. 6A and 6B illustrate cross-sectional views showing portions of brace body in a loosened state and a tightened state, respectively, on a longitudinal support, in accordance with some embodiments of the present disclosure.
Figure 6B:
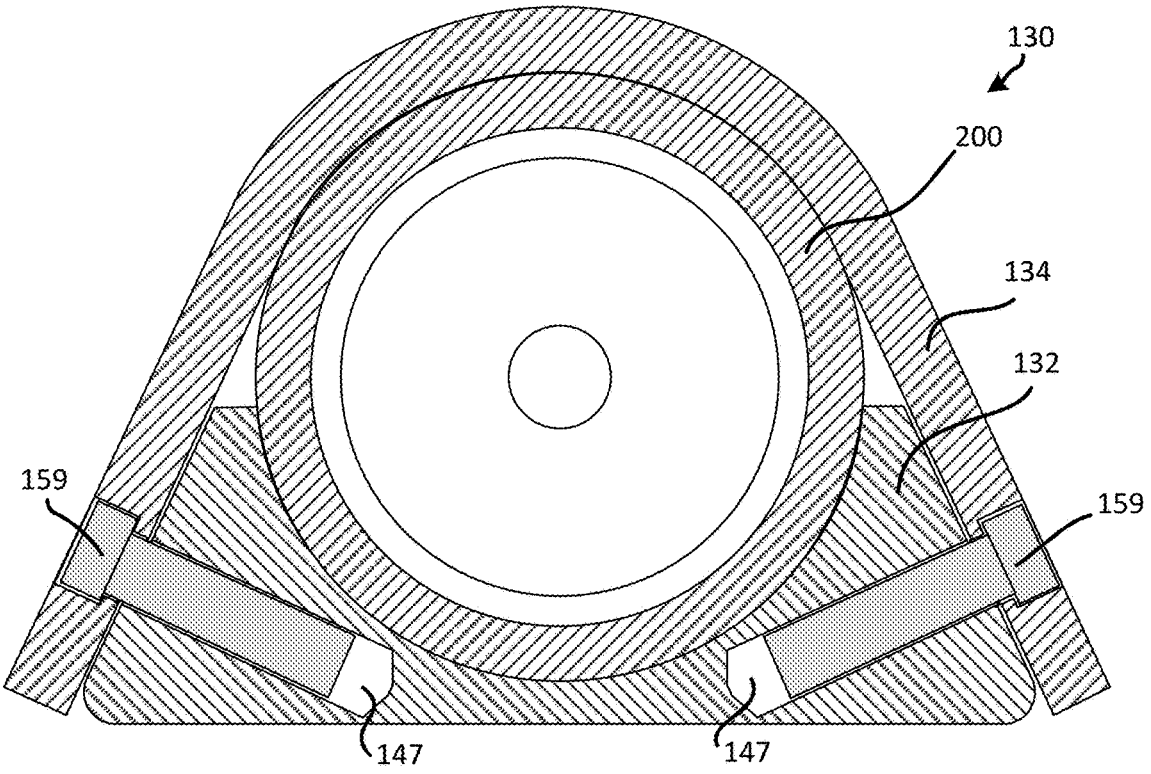

FIGS. 6A and 6B illustrate cross-sectional views of brace body 130 in a loosened state and a tightened state, respectively, on a longitudinal support 200, in accordance with an embodiment of the present disclosure. In this example, upper body member 134 and lower body member 132 are configured as shown in FIGS. 4 and 5, respectively. In the loosened or resting state shown in FIG. 6A, fasteners 159 (e.g., machine screws) extend through the side portions 138 of the upper body member 134 and into the base 143 of the lower body member 132. Note that the fasteners 159 have not been fully tightened in FIG. 6A. Accordingly, a gap exists between the side portions 138 and the base 143. As the fasteners 159 are advanced into the fastener bores 147 to a tightened condition, such as shown in FIG. 6B, the side portions 138 of the upper body member 134 are drawn down and inward, tightening the body members 132, 134 towards each other and against the top and bottom of the longitudinal support 200. In the tightened state, the lower body member 132 and upper body member 134 snugly engage opposite surfaces of the longitudinal support 200. As shown in FIG. 6B, the lower and upper body members 132, 134 contact the longitudinal support 200 along most of the circumference (e.g., at least than 80% of the circumference). In the tightened state, the brace assembly 100 provides sufficient frictional engagement to stabilize the position of the brace assembly 100 on the longitudinal support 200 and inhibit or prevent rotation and axial movement of the brace assembly 100 with respect to the longitudinal support 200.

Figure 7A:
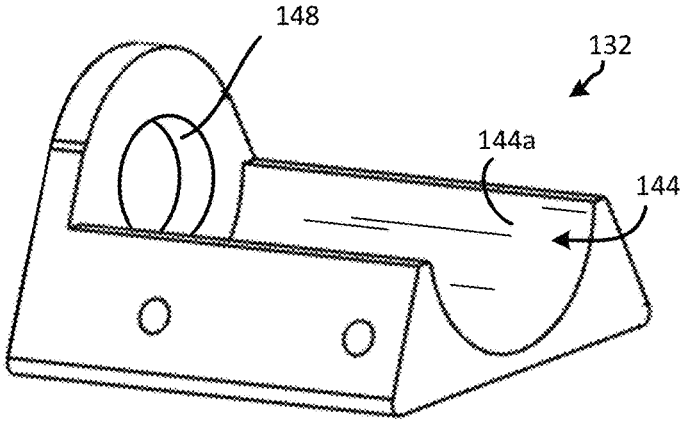
FIGS. 7A and 7B illustrate a front perspective view of a lower body member and a longitudinal support, respectively, where the longitudinal support includes a mounting post on its proximal end portion, in accordance with an embodiment of the present disclosure.
Figure 7B:
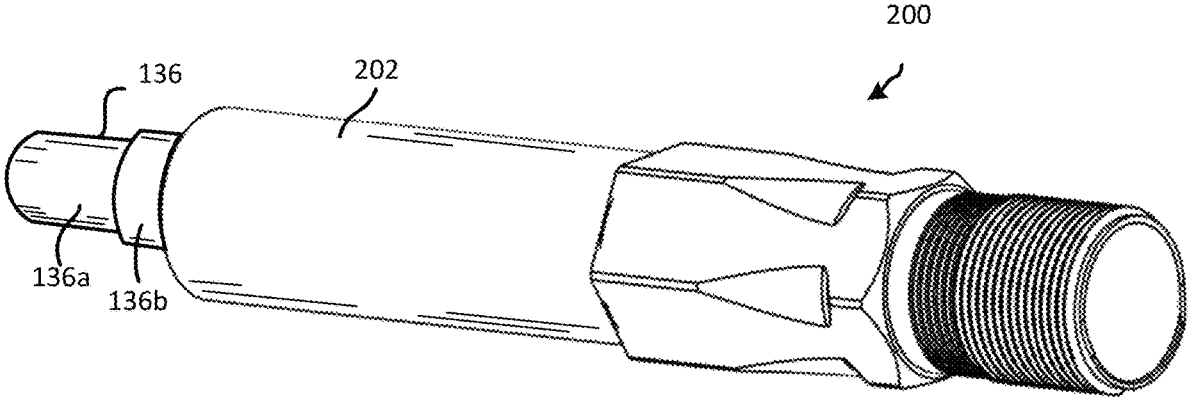

FIG. 7A illustrates a front perspective view of a lower body member 132 and FIG. 7B illustrates a front perspective view of a longitudinal support 200 that includes a mounting post 136, in accordance with some embodiments of the present disclosure. Longitudinal support 200 includes mounting post 136 extending axially from the proximal end of the cylindrical portion 202. Mounting post 136 can be integral to longitudinal support 200 or can be a separate component that is fastened to longitudinal support 200. Lower body member 132 defines recess 144 having a semicircular inside surface 144*a* and configured to engage the cylindrical portion 202 of the longitudinal support 200. The rear wall 146 defines an opening 148 sized to receive mounting post 136 therethrough when the cylindrical portion 202 is received in the recess 144. In such embodiments, the brace plates 180 can be pivotably attached to the mounting post as discussed above.

Figure 8:
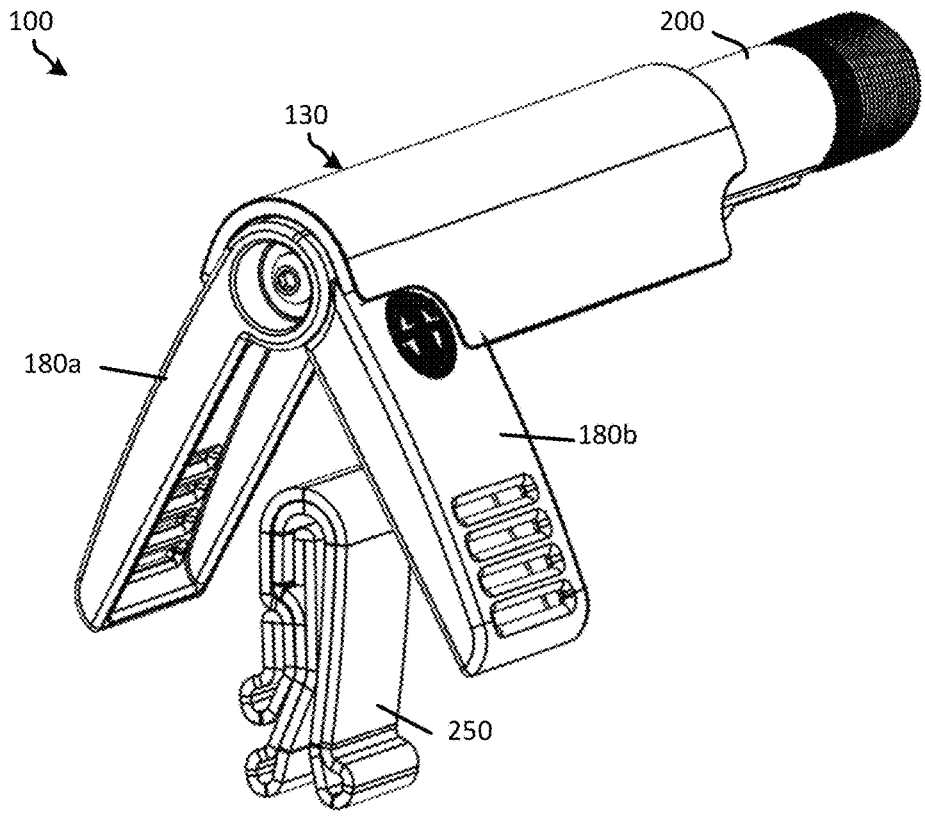
FIG. 8 illustrates a rear perspective view of a brace assembly and a longitudinal support with the brace plates in an open position, in accordance with an embodiment of the present disclosure. Note that the strap is illustrated in a folded condition between the brace plates.
Figure 9:
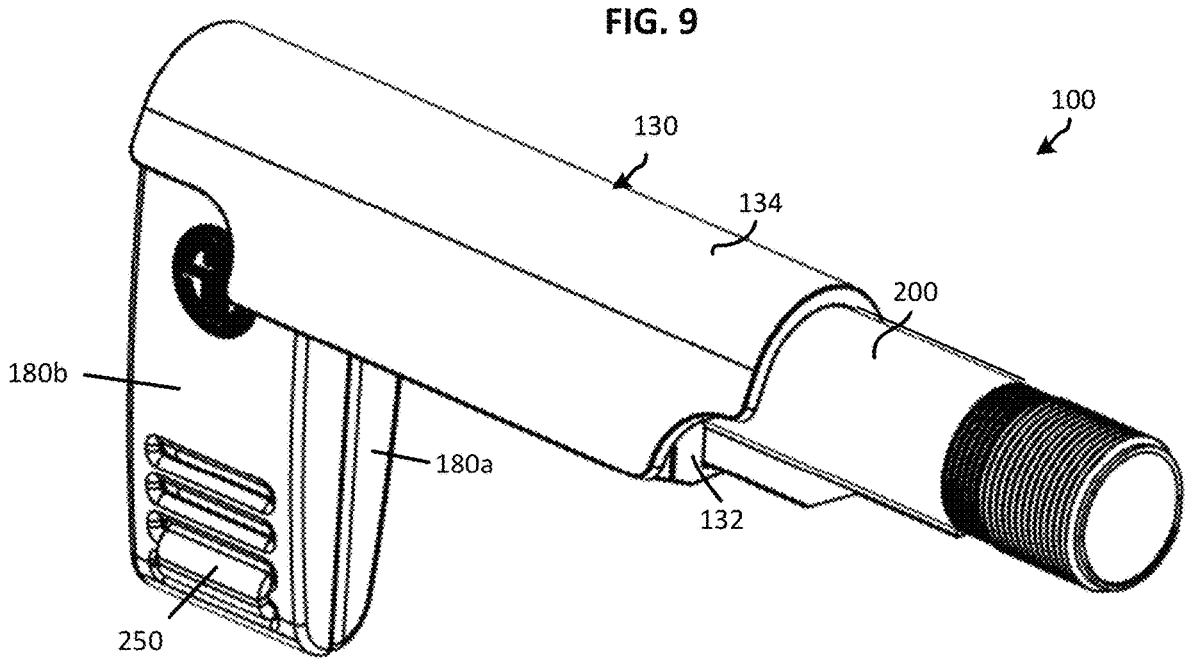
FIG. 9 illustrates a front perspective view of a brace assembly and longitudinal support with the brace plates in a closed position and the flexible strap is threaded through openings in the brace plates, in accordance with an embodiment of the present disclosure.
Figure 10:
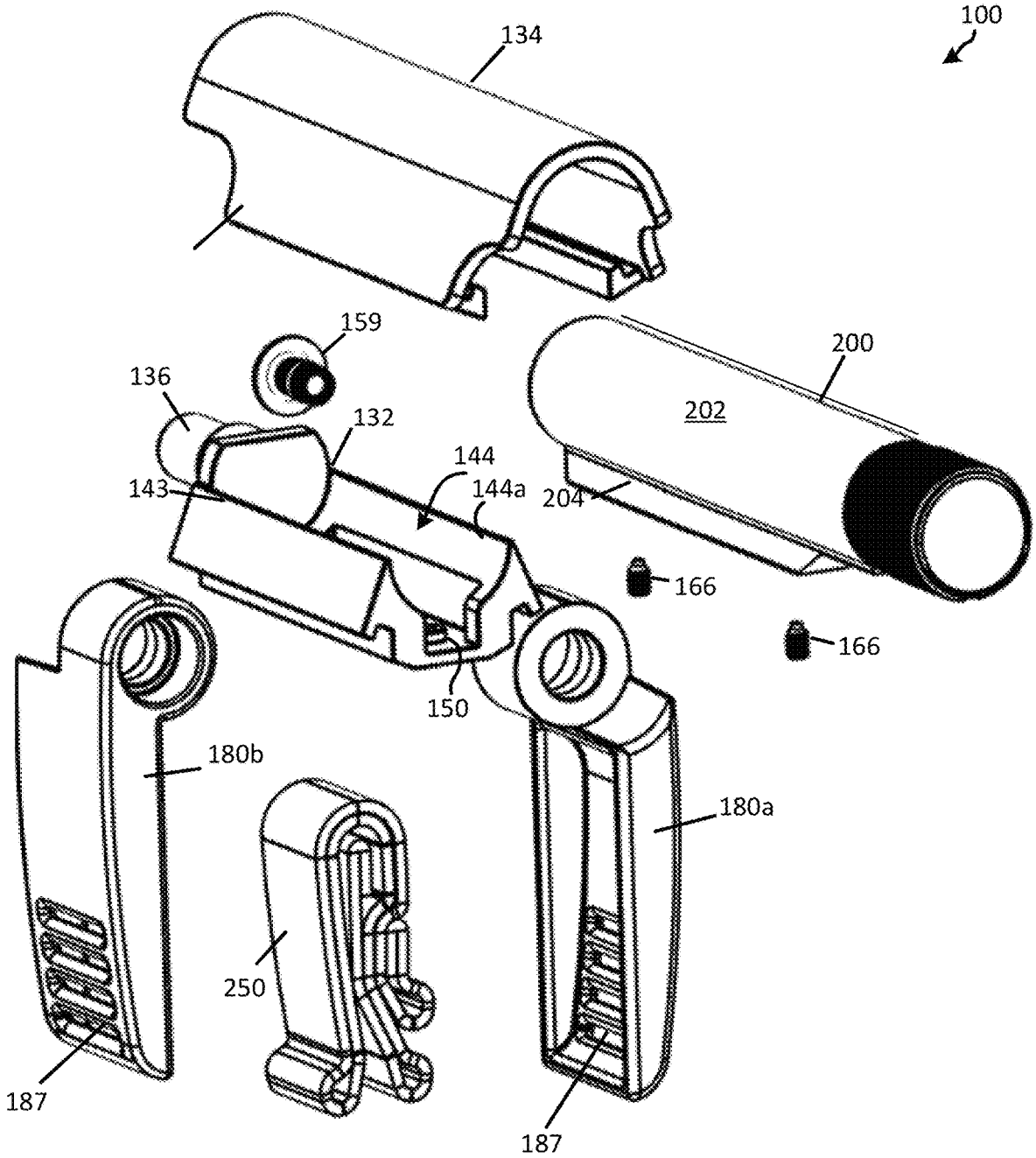
FIG. 10 illustrates an exploded front perspective view of brace assembly and longitudinal support, in accordance with an embodiment of the present disclosure.
Figure 11:
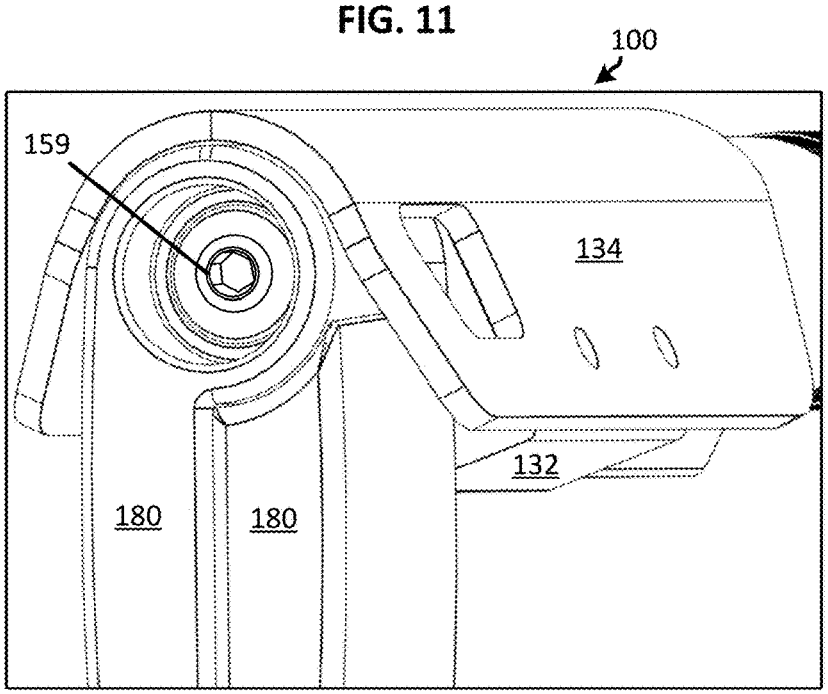
FIG. 11 illustrates a rear perspective view showing part of the longitudinal support of FIGS. 8-10, in accordance with an embodiment of the present disclosure.
Figure 12:
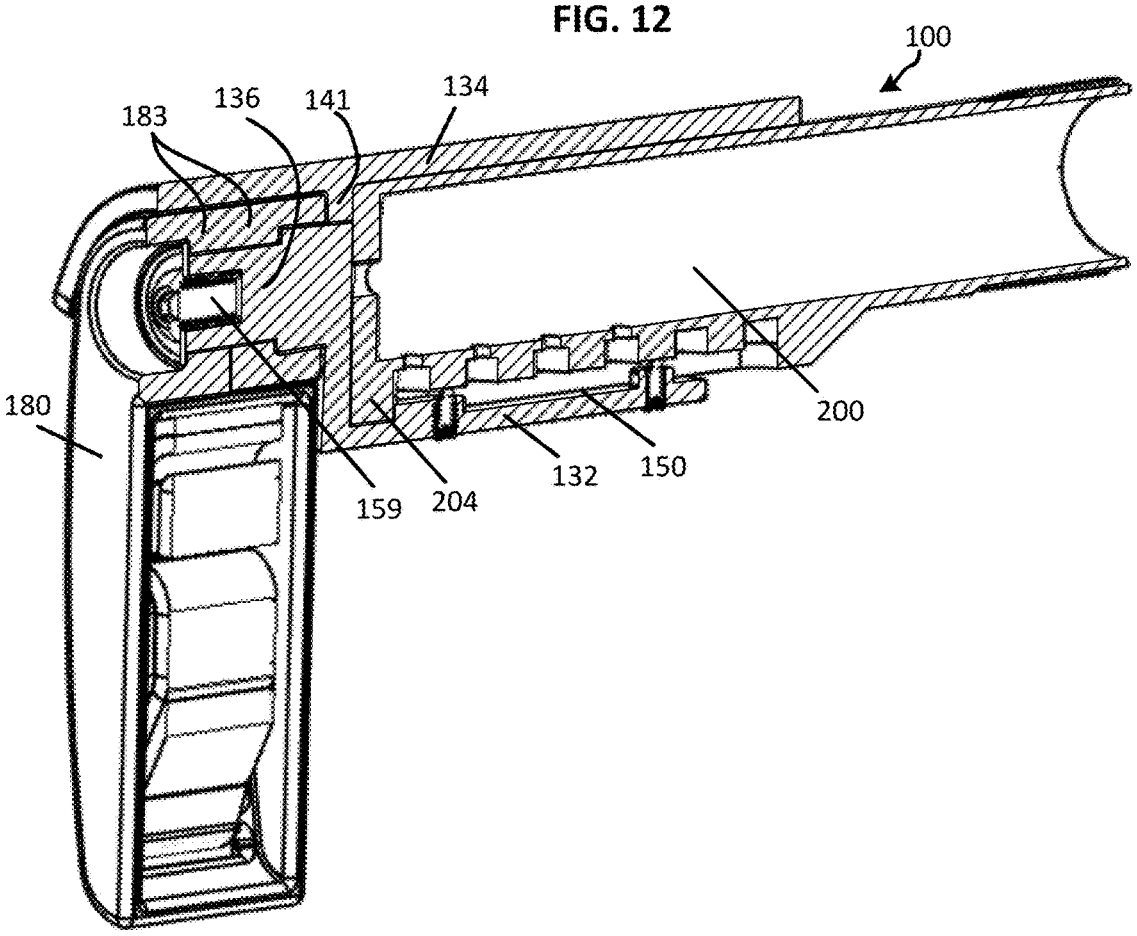
FIG. 12 illustrates a rear perspective view showing a longitudinal section of the brace assembly shown in FIGS. 8-10, in accordance with an embodiment of the present disclosure.

Referring to FIGS. 8-12, rear and front perspective views show a brace assembly 100 mounted to a longitudinal support 200 of a firearm, in accordance with another embodiment of the present disclosure. FIG. 8 illustrates a rear perspective view of brace assembly 100 and longitudinal support 200 with brace plates 180 in an open position. FIG. 9 illustrates a front perspective view of brace assembly 100 and longitudinal support 200 with brace plates 180 in a closed position. FIG. 10 illustrates an exploded front perspective view of brace assembly 100 and longitudinal support 200. FIG. 11 is a rear perspective view showing the brace assembly 100 with the brace plates 180 in a closed position. FIG. 12 is a perspective view showing a longitudinal section taken along the median plane of the brace assembly 100. These figures will be described concurrently.

Similar to embodiments discussed above, brace assembly 100 includes a two-part brace body 130 that can be attached to the longitudinal support 200, such as a buffer tube or receiver extension. The brace body 130 includes a lower body member 132 (shown more clearly in FIG. 10) and an upper body member 134. The lower and upper body members 132, 134 are configured to assemble with one another and to engage the longitudinal support 200. For example, the lower body member 132 and upper body member 134 interlock when assembled.

A first brace plate 180*a* and a second brace plate 180*b* (collectively, brace plates 180) are pivotably attached to mounting post 136 that extends rearwardly from the lower body member 132. A flexible strap 250 is shown in a folded configuration in FIGS. 8 and 10. As noted above, the flexible strap 250 can pass through strap openings 187 in the brace plates 180 to define a loop to encircle the user's arm. As shown in FIG. 10, fasteners 166 can be used to secure the longitudinal support 200 to the lower body member 132 and fastener 159 can be used to secure the brace plates 180 on the mounting post 136. For example, ends of each fastener 166 can abut the longitudinal support 200 to increase the frictional grip of the brace body 130.

FIG. 11 illustrates a close-up rear perspective view of part of the brace assembly 100 with the brace plates 180 in a closed position. FIG. 12 illustrates a side and rear perspective view showing a longitudinal section of brace assembly 100. Brace plates 180 are retained on the mounting post 136 by fastener 159, which in turn retains upper body member 134 assembled with lower body member 132. As noted above, the brace plates 180 and longitudinal support 200 each provide an obstruction in the path of the transverse wall 141 and prevent removing the upper body member 134 from the brace assembly 100 by sliding rearward or forward with respect to the lower body member 132. Thus, in some embodiments, the brace plates 180 must be removed from the mounting post 136 prior to removing the upper body member 134 from the lower body member 132. As can also be seen in FIG. 16, the flange 204 is received in the channel or slot 150 defined in the lower body member 132.

Referring to FIG. 13, a bottom perspective view shows the longitudinal support 200 shown in FIGS. 8-12, in accordance with one embodiment. In this example, the longitudinal support 200 is a buffer tube as traditionally provided on M4 carbine rifles and similar firearms. The longitudinal support 200 includes a cylindrical portion 202 and a flange 204 extending part way along the bottom of the cylindrical portion 202. The flange 204 has a generally rectangular cross-sectional shape with a lateral width W. In some embodiments, the flange 204 defines a longitudinal recess 205 in addition to one or more circular recesses 206 distributed along the length of the longitudinal recess 205, each circular recess 206 having a greater depth than the longitudinal recess 205. The circular recess can enable multi-position stocks to be moved between one of a plurality of predetermined positions along the longitudinal support 200. The distal end portion 208 is threaded for attachment to the lower receiver of a firearm, as will be appreciated.

Figure 14A:
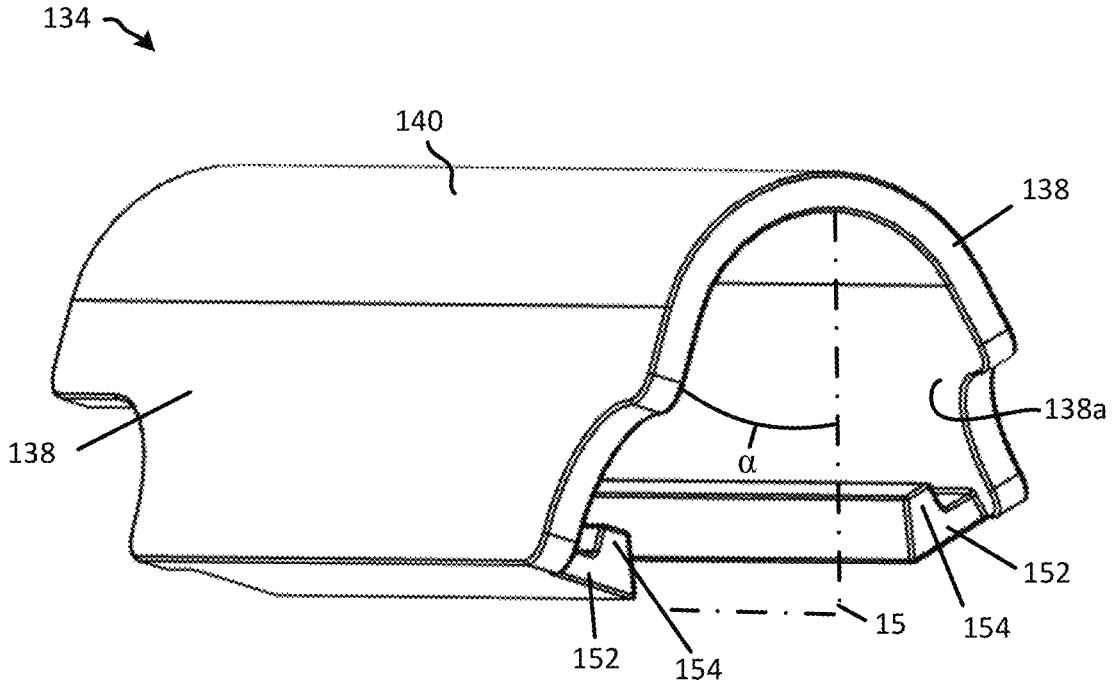
FIGS. 14A and 14B illustrate a front perspective view and a rear perspective view, respectively, of upper body member, in accordance with an embodiment of the present disclosure.
Figure 14B:
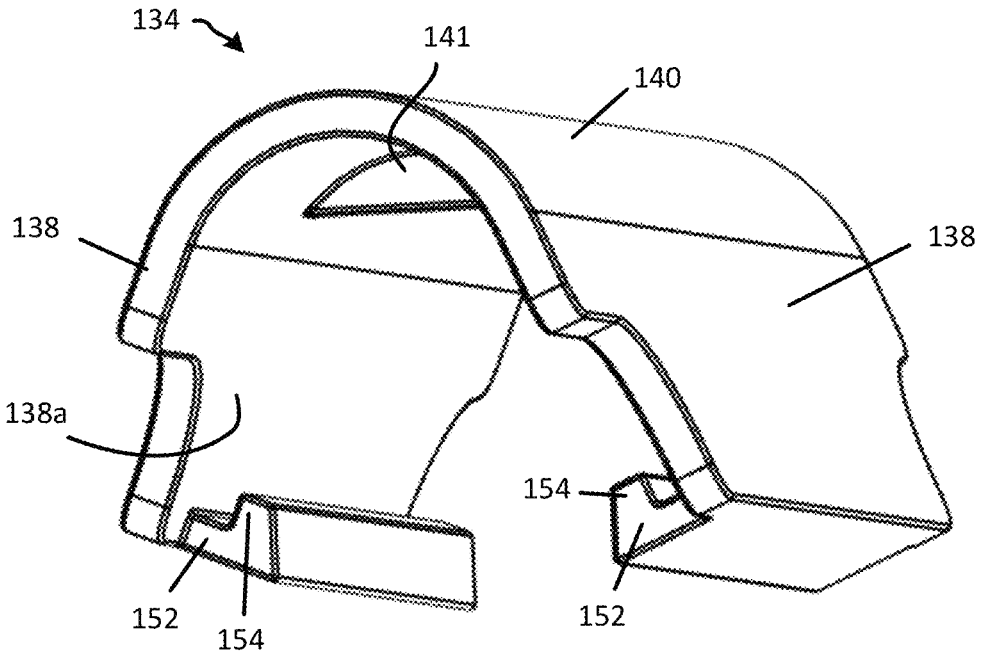

Referring now to FIGS. 14A and 14B, a front perspective view and a rear perspective view, respectively, illustrate upper body member 134 as shown in FIGS. 8-12. In this example, upper body member 134 has a domed shape with side portions 138 extending down from an arcuate top portion 140, where the side portions 138 have a generally planar inside surface 138*a*. The top portion 140 is shaped to mate with the cylindrical portion 202 of the longitudinal support 200. In some such embodiments, the top portion 140 is part of a cylinder that is sized to contact and mate with the longitudinal support 200 along its rounded top surface. A transverse wall 141 extends vertically down from the inside of top portion 140 and is positioned to align with the rear wall 146 of the lower body member 132. In the assembled state, the transverse wall 141 is located between the upper end portion 183 of the brace plates 180 and the end of the longitudinal support 200. Accordingly, the transverse wall 141 would contact the upper end portion 183 of one of the brace plates 180 or the longitudinal support 200 during an attempt to slide the upper body member 134 forward or rearward along the brace assembly 100.

In some embodiments, each side portion 138 defines an angle $\alpha$ of from 0-45° with respect to the median plane 15, including angle $\alpha$ of 10-30°, 20-35°, 20-30°, and about 25°, for example. An L-shaped shelf 152 is connected to and extends generally inward from the bottom of each side portion 138. The L-shape of each shelf 152 defines a hook 154 extending upward. For example, the shelf 152 extends perpendicularly from the side portion 138 with the hook 154 spaced from the side portion 138 and extending upward towards the top portion 140. In some embodiments, the hook 154 is parallel to the side portion 138. The L-shape of the shelf 152 provides a geometry that is useful to engage and lock with a corresponding slot in the lower body member 132, as discussed below.

Figure 15A:
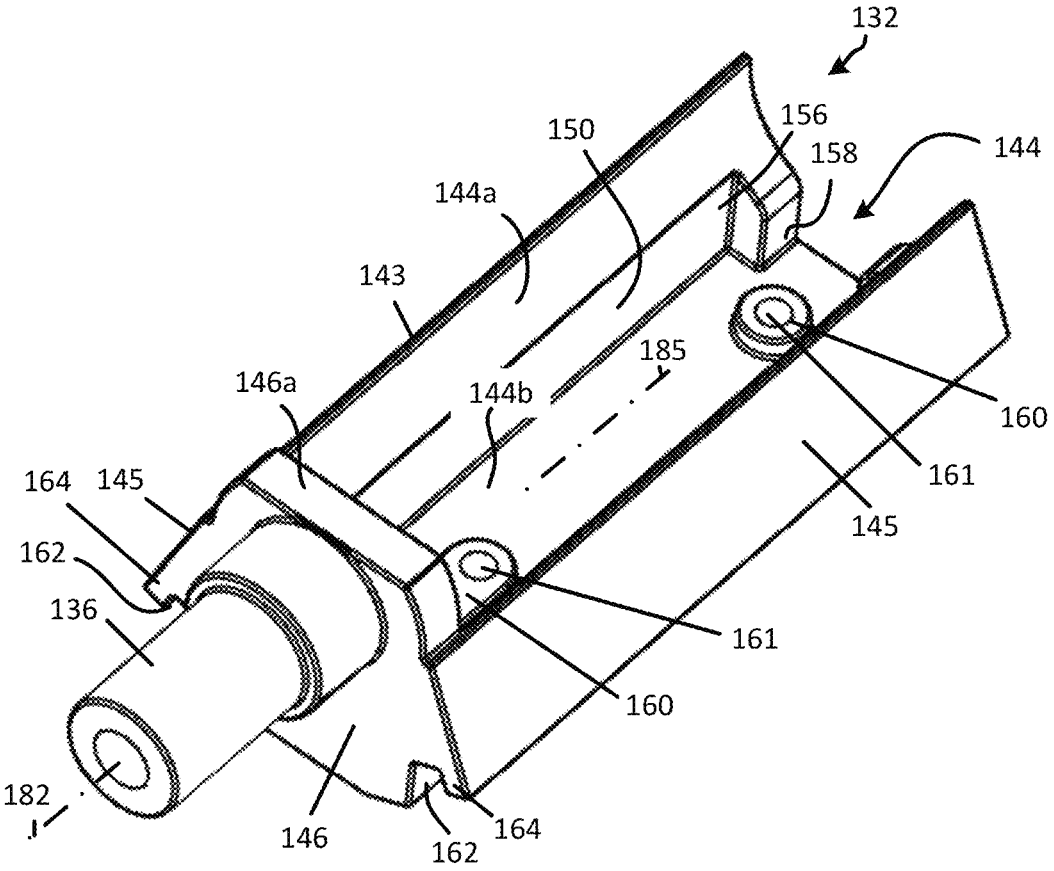
FIGS. 15A and 15B illustrate a top and rear perspective view and a top plan view, respectively, of a lower body member of the brace assembly shown in FIGS. 8-10, in accordance with an embodiment of the present disclosure.
Figure 15B:
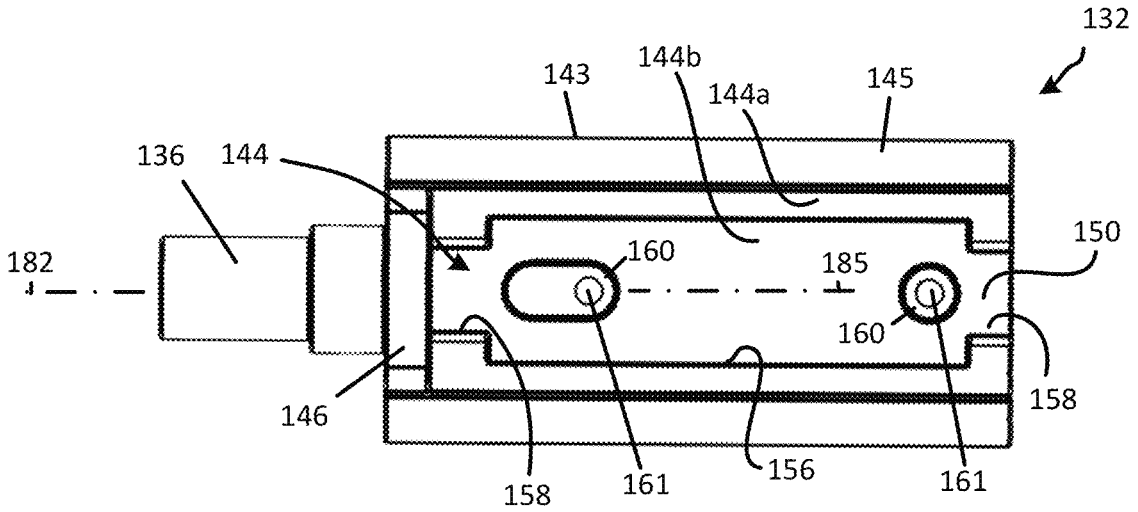

Referring to FIGS. 15A and 15B, a top and rear perspective view and a top plan view, respectively, illustrate lower body member 134 as shown in the brace assembly 100 of FIGS. 8-12, in accordance with one embodiment. The lower body member 132 includes a base 143 defining a recess 144 that includes a curved inside surface 144*a* and a slot 150, where the recess 144 is shaped to receive the longitudinal support 200 shown in FIG. 13 or one of similar geometry. The slot 150 intersects the curved inside surface 144*a* and extends down into the base 143 below the curved inside surface 144*a*. The slot 150 is sized to accommodate the flange 204 on the bottom of the longitudinal support 200, if present. In some embodiments, a middle portion 156 of the slot 150 can have a width that is greater than width W of the flange 204, and end portions 158 can be equal to or slightly larger than the width W of the flange 204 so as to provide a fit with minimal or no gap. In this example, the curved inside surface 144*a* is semicircular and is sized to contact the outside of the cylindrical portion 202 of the longitudinal support 200, but it could similarly receive a longitudinal support 200 of other geometry that is sized to fit into the base 143, such as a beam having a cross-sectional shape of a rectangle with rounded top and bottom surfaces having a radius of curvature consistent with that of the curved inside surface 144*a*.

The base 143 optionally has one or more bosses 160 that protrude up from the bottom surface 144*b* of the recess 144. The bosses 160 are positioned to be received in the longitudinal recess in the flange 204. Some bosses 160 may further be sized and positioned to be received in a circular recess 206. Some or all of the bosses 160 optionally define a fastener opening 161 aligned between circular recesses 206 in the longitudinal support 200, such as shown in FIG. 13. A fastener 166 or the like can be advanced through each fastener opening 161 to engage the longitudinal support 200 to remove play in the brace assembly 100. When the bosses 160 engage side or end walls of the longitudinal recess 205 and the flange 204 is positioned in the slot 150, lateral and axial movement can be minimized or eliminated between the longitudinal support 200 and the lower body member 132.

A rear wall 146 connects to the rear end of the base 143 and extends vertically upward between the outer side surfaces 145. As discussed above, the rear wall 146 can be used as a stop surface for the longitudinal support 200. The mounting post 136 is connected to and extends rearward from the rear wall 146 along the pivot axis 182. The base 143 also includes opposite outer side surfaces 145 that extend downward and outward with respect to a central axis 185 of the recess 144. The base 143 defines longitudinal channels 162 below each outer side surface 145, where each channel 162 is sized and positioned to matingly receive the hook 154 on the L-shaped shelf 152 of the upper body member 134. For example, the upper body member 134 can be assembled with the lower body member 132 by sliding the upper body member 134 onto the lower body member 132 with each hook 154 received in the corresponding channel 162. Adjacent each channel 162 is an overhang 164 that can be received between the side portion 138 and the hook 154 of the upper body member 134. In some embodiments, the inside surface 138*a* of each side portion 138 of the upper body member 134 contacts the outer side surfaces 145 of the lower body member 132 when assembled.

Figure 16:
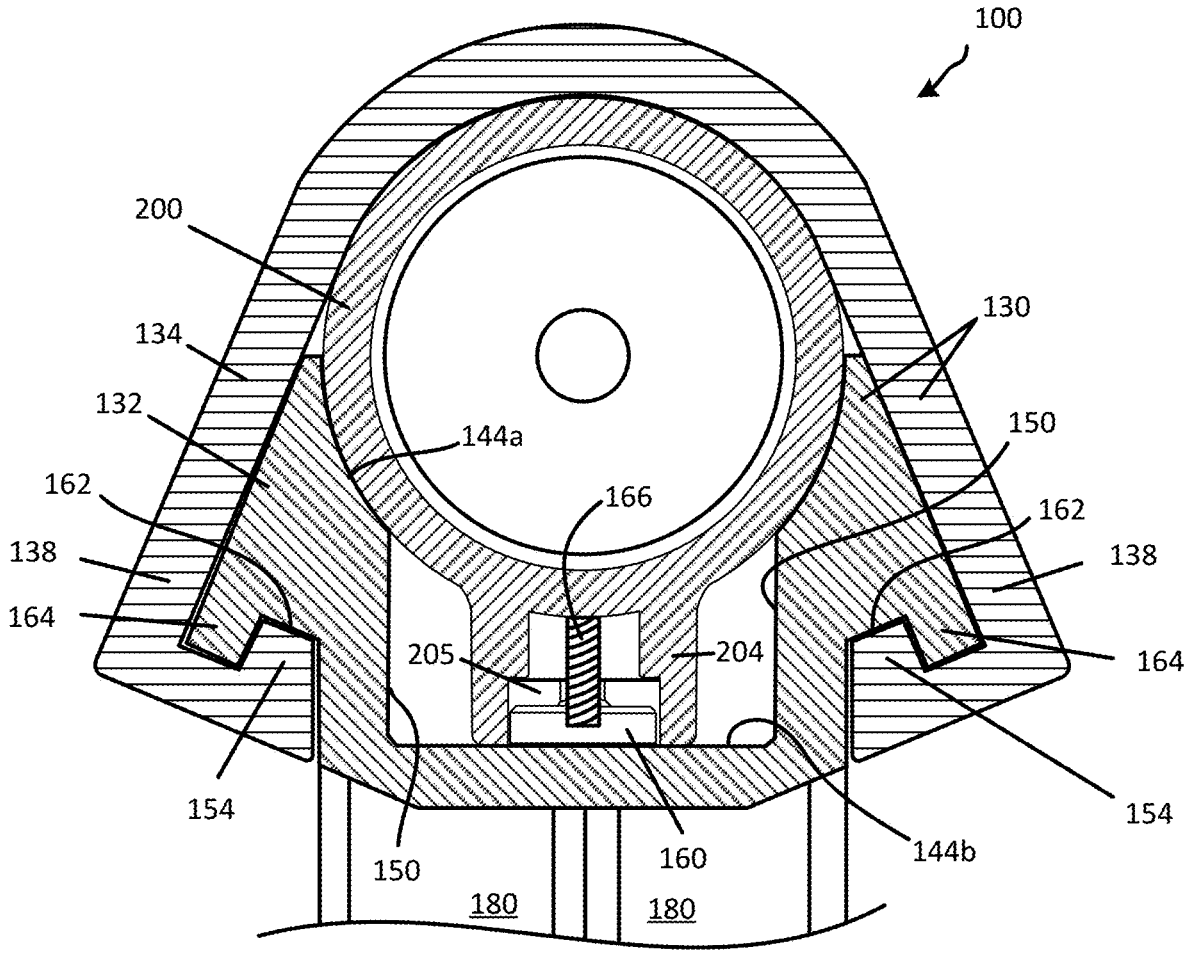
FIG. 16 illustrates a cross-sectional view of a brace body installed on a longitudinal support, in accordance with an embodiment of the present disclosure.

FIG. 16 illustrates a front cross-sectional view showing a brace assembly 100 installed on a longitudinal support 200, where the section is taken through the brace body 130 at a location distally of the brace plates 180, in accordance with an embodiment of the present disclosure. In this example, upper body member 134 and lower body member 132 are configured as shown in FIGS. 14 and 15, respectively. The brace body 130 frictionally engages the longitudinal support 200 to stabilize the position of the brace assembly 100 and to reduce or prevent rotation and axial movement of the brace assembly 100 with respect to the longitudinal support 200. The upper body member 134 engages the rounded top surface of the longitudinal support 200, which follows a cylindrical shape. The curved inside surface 144*a* of the lower body member 132 engages the lower side portions of the longitudinal support 200, and the bottom surface 144*b* of the recess 144 in the lower body member 132 engages the flange 204. In other embodiments, the bottom surface of the flange 204 may not contact the bottom surface 144*b* of the slot 150. The hook 154 on each L-shaped shelf 152 is received in the corresponding longitudinal channel 162 along the upper body member 134, and the overhang 164 is received in a slot between the side portion 138 and hook 154 of the lower body member 132.

To enhance the frictional engagement between the brace body 130 and the longitudinal support 200, to enhance frictional engagement between the lower and upper body members 132, 134, and/or to eliminate any play in the assembly, a fastener 166 (e.g., a set screw) can be advanced through one or more bosses 160 so that the end of the fastener 166 contacts the cylindrical portion 202 of the longitudinal support 200. In doing so, the lower and upper body members 132, 134 are in tension about the longitudinal support 200 such that the upper body member 134 more tightly engages the top of the cylindrical portion 202 and the lower body member 132 more tightly engages the upper body member 134 at the interlock between the overhang 164, hook 154 on the L-shaped shelf 152, and channel 162. In addition to frictional engagement, rotational and linear movement between components is prevented or reduced by structural obstacles, including the flange 204 being received in the slot 150, the boss(es) 160 received in the longitudinal recess 205, and the longitudinal support 200 abutting the rear wall 146 of the lower body member 132.

In its assembled state, the lower and upper body members 132, 134 can provide a clamping force for secure engagement to a cylindrical buffer tube or cylindrical portion 202 of a longitudinal support 200. In other embodiments where the longitudinal support 200 is not truly cylindrical, the brace assembly 100 uses the asymmetric shape to prevent rotation of the brace assembly 100 about the longitudinal support 200, while also using frictional engagement and/or interference between components to prevent axial movement along the longitudinal support 200. For example, some embodiments of the brace assembly 100 utilize a combination of frictional engagement and structural cooperation between the components to minimize or eliminate play in the brace assembly 100. By eliminating excess movement between components, rattling and similar sounds also can be eliminated or greatly reduced. Accordingly, the brace assembly 100 advantageously can be made to be very quiet during use and while moving the brace members 180 between the open position and the closed position.

Figure 17:
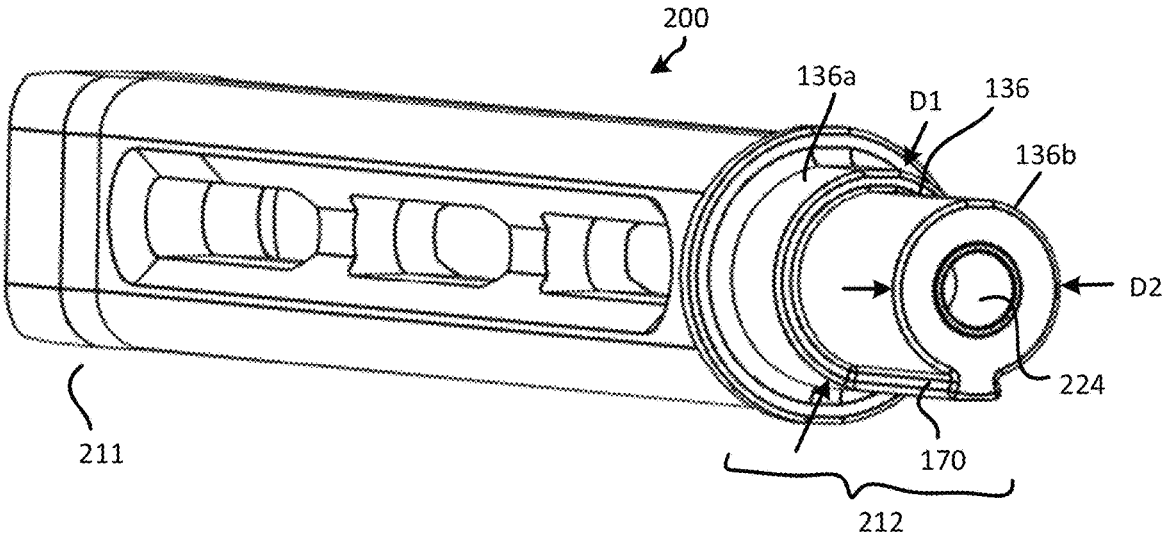
FIG. 17 illustrates a rear perspective view of a longitudinal support with a keyed mounting post, in accordance with an embodiment of the present disclosure.
Figure 18:
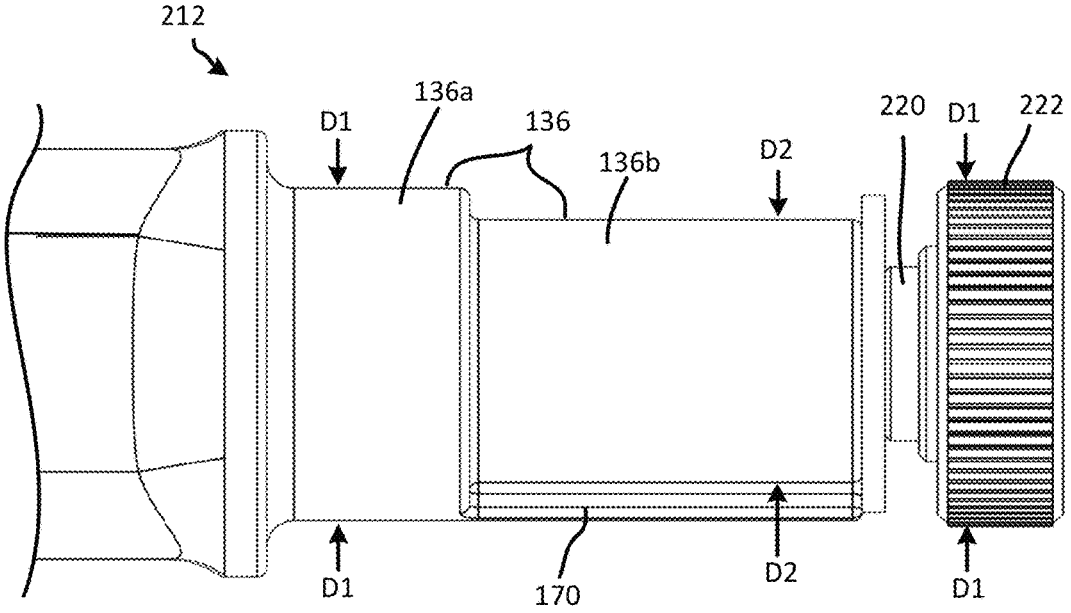
FIG. 18 illustrates a side view of the mounting post shown in FIG. 17, in accordance with an embodiment of the present disclosure.

Referring to FIG. 17, a side and rear perspective view shows a longitudinal support 200, in accordance with an embodiment of the present disclosure. FIG. 18 shows an enlarged side view of the proximal end portion 212. In this example, longitudinal support 200 has a beam-like construction with a generally rectangular cross-sectional shape. For example, the cross-sectional shape can be a square or rectangle with rounded top and bottom surfaces. A distal end portion 211 is constructed for attachment to a mounting bracket (not shown). For example, longitudinal support 200 defines one or more threaded fastener openings to secure a mounting bracket.

A proximal end portion 212 includes a mounting post 136 constructed to mount brace plates 180. The mounting post 136 has a region of first diameter 136*a* and a region of a second diameter 136*b*, where the region of second diameter 136*b* is of a different size (e.g., smaller second diameter D2) compared to diameter D1 along the region of first diameter 136*a*.

In one embodiment, a fastener 220 can be installed into a fastener opening 224 in the end of the mounting post 136. A variety of retention mechanisms can be used between the fastener and the mounting post 136, including threads, spring ball detents, a friction fit, or other suitable mechanism. The fastener 220 functions as a proximal stop to retain brace plates 180 on the mounting post 136. In this example, the fastener 220 includes a cap 222 having an outer diameter that is greater than second diameter D2 of the region of second diameter 136*b*. In some embodiments, the fastener cap 222 has a diameter D1 that is the same or substantially the same as the first diameter D1 of the region of first diameter 136*a*. As such, the fastener 220 and cap 222 can be part of a generally symmetrical profile along mounting post 136 that includes a region of reduced diameter (region of second diameter 136*b*) between regions of larger diameter (region of first diameter 136*a* and fastener cap 222). In addition to functioning as a physical barrier to the brace plates 180 sliding off of the mounting post 136, the fastener 220 can be selectively tightened so that the brace plates 180 maintain a given position during use, rather than returning to a vertical position due alone to gravity. Further tightening the fastener 220 can increase the force needed to move each brace plate 180.

The mounting post 136 includes a key 170 that protrudes radially from a bottom of the mounting post 136 and extends axially along the region of second diameter 136*b*. In one example, the key 170 has a rectangular or trapezoidal cross-sectional shape. In one embodiment, the key 170 extends radially a distance equal to the difference in radius between the region of first diameter 136*a* and region of second diameter 136*b*. Accordingly, the key 170 can be made flush with the region of first diameter 136*a*. In other embodiments, the radial height of the key 170 can have any value suitable so that the key 170 functions as a stop for one or both brace plates 180. The key 170 is illustrated as extending downward from the bottom surface of the mounting post 136, although other locations for the key 170 are acceptable. The key 170 can be integrally formed as part of the mounting post 136, or the key 170 may be a separate component that is attached to the mounting post 136 by welding, fasteners, or other suitable method. The key 170 functions as a stop to limit the range of rotational motion of one or both brace plates 180. In some embodiments, the mounting post 136 can have two keys 170, one for each brace plate 180. For example, each key 170 extends part way along the axial length of the region of second diameter 136*b* to function as a stop for a respective one of the brace plates 180.

Figure 19A:
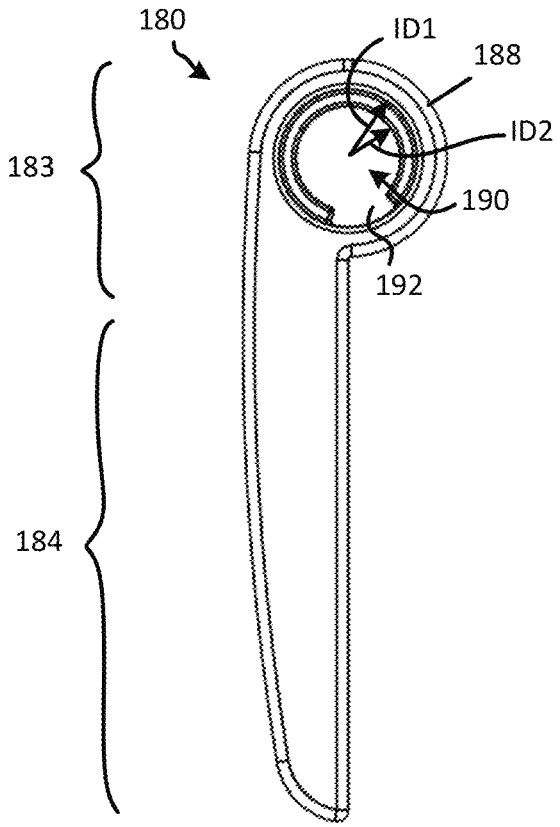
FIGS. 19A and 19B illustrate an end view and a perspective view, respectively, of a brace plate that defines a keyway in the opening of the upper end portion, in accordance with an embodiment of the present disclosure.
Figure 19B:
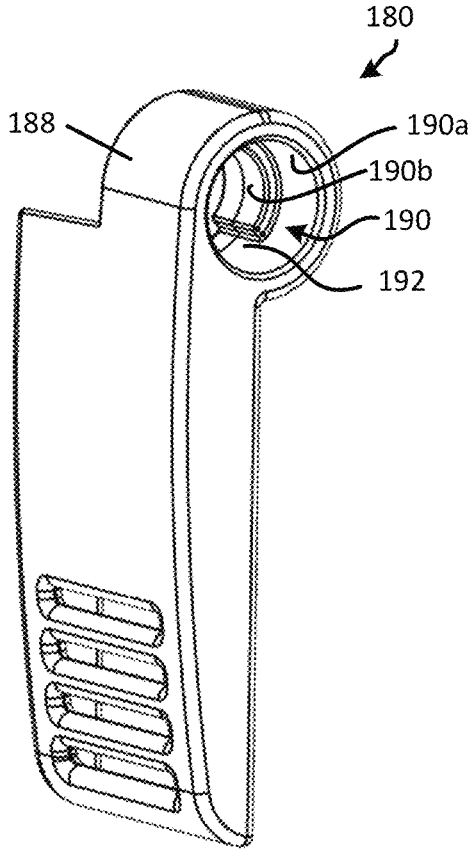

Referring now to FIGS. 19A and 19B, an end view and a perspective view, respectively, illustrate a brace plate 180, in accordance with an embodiment of the present disclosure. Only one brace plate 180 is described since both brace plates 180 have an identical geometry, in some embodiments. The brace plate 180 includes a lower end portion 184 constructed to engage the user's arm, and an upper end portion 183 that includes a hinge knuckle 188 constructed with a through-opening 190 to receive mounting post 136 therethrough. The through opening 190 includes a first opening portion 190*a* of a first diameter ID1 and a second opening portion 190*b* of a smaller second diameter ID2. The second opening portion 190*b* defines a keyway 192 configured to accept the key 170 when the brace plate 180 is installed on the mounting post 136. In more detail, the keyway 192 can be a recess or slot through the second opening portion 190*b* and having a circumferential length sized to permit the brace plate 180 to rotate about the mounting post 136 a desired amount. In one embodiment, the keyway 192 is sized to permit the brace plate 180 to rotate, for example, from 15-45°, including 20-40°, 25-35°, or about 30° when accounting for the circumferential width of the key 170. In other embodiments, the second opening portion 190*b* can function as key 170, such as when second opening portion 190*b* has a circumferential span of 10-15 degrees along the inside of the opening 190, for example.

Figure 20A:
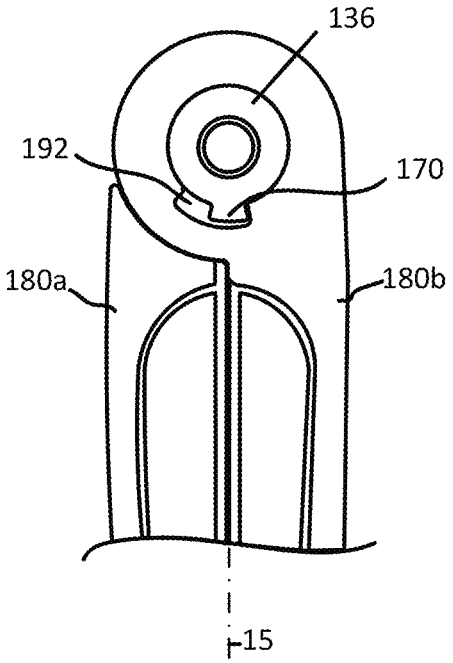
FIGS. 20A and 20B illustrate an end view of a brace assembly in a closed position and an open position, respectively, where the rotation of each brace plate is limited by a stop or key on the mounting post, in accordance with some embodiments of the present disclosure.
Figure 20B:
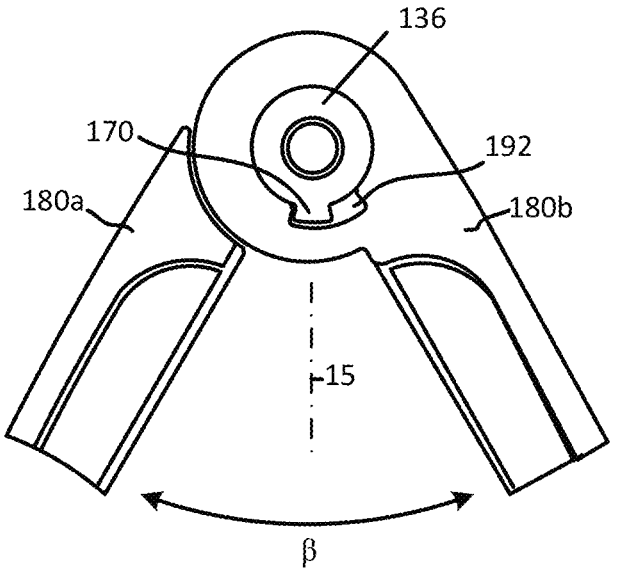

FIGS. 20A and 20B illustrate an end view of brace plates 180 on a mounting post 136 in closed and open positions, respectively, in accordance with an embodiment of the present disclosure. In FIG. 20A, first and second brace plates 180*a*, 180*b* are in a closed position in which the brace plates 180 abut or nearly abut in opposed alignment along the median plane 15. In FIG. 20B, first and second brace plates 180*a*, 180*b* each are rotated about the mounting post 136 so as to be displaced away from the median plane 15. In each of FIGS. 20A-20B, the key 170 on the mounting post 136 acts as a stop within the keyway 192 of second brace plate 180*b*. Although not visible in these figures, the key 170 similarly functions as a stop with the keyway 192 of the first brace plate 180*a*. For each brace plate 180, the key 170 and keyway 192 define the limits of rotation and the position of the brace plate 180 at each limit. In these figures, one limit corresponds to the closed position, such as shown in FIG. 20A and the other limit corresponds to the fully open position, such as shown in FIG. 20B.

The brace plates 180 can, but need not, have the same range of rotational movement. Similarly, the keyway 192 of each brace plate 180 can, but need not, define the same or similar position of the brace plate 180 when at either limit of movement. For example, the first brace plate 180*a* can have a 30° range of movement and the second brace plate 180*b* can have a 40° range of movement. In some embodiments, both brace plates 180 can pivot between the closed position with the inner face of the brace plate 180 at the median plane 15, and an open position rotated away from the median plane 15. In combination, the angular spread β between the brace plates 180 can be 30-90°, including 40-80°, 45-75°, 50-70°, 55-65°, or about 60°, in accordance with some embodiments.

In some embodiments, one of the brace plates 180 (e.g., first brace plate 180*a*) can maintain a fixed position. In one example, the fixed position is so that first brace plate 180*a* is aligned with median plane 15. In some such embodiments, the second brace plate 180*b* can pivot about the mounting post 136 to accommodate a user's forearm between the brace plates 180. The flexible strap 250 (shown in FIGS. 8-10) can be threaded through openings in each brace plate 180 and then tightened around the user's arm to secure the firearm.

Figure 21:
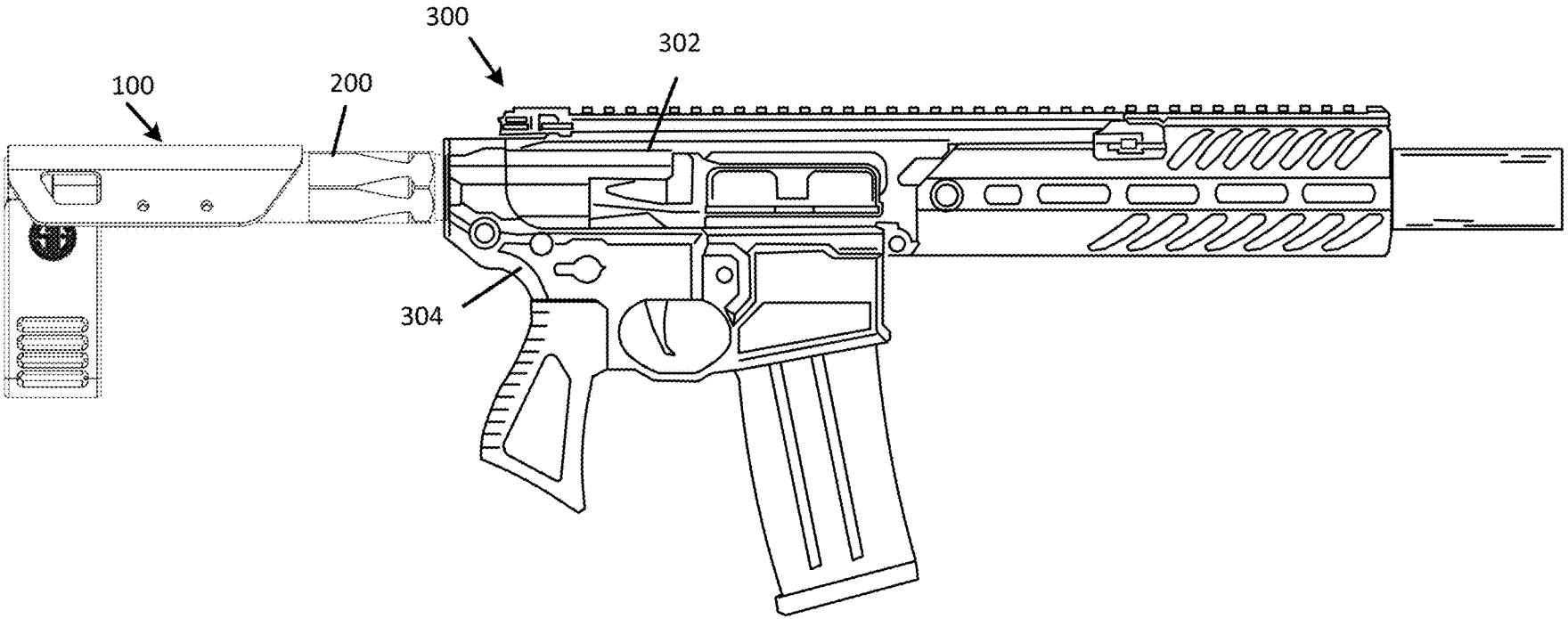
FIG. 21 illustrates a side view of a brace assembly installed on a receiver extension of a firearm, in accordance with an embodiment of the present disclosure.

FIG. 21 illustrates a side view of a brace assembly 100 installed on a firearm 300, in accordance with one embodiment. The brace assembly 100, shown in FIGS. 8-9, is attached to a receiver extension or equivalent longitudinal support 200. In this example, the firearm 300 is a pistol configured to fire rifle cartridges and includes an upper receiver 302 and a lower receiver 304. The longitudinal support 200 is screwed into the rear end of the lower receiver 304.

Figure 22:
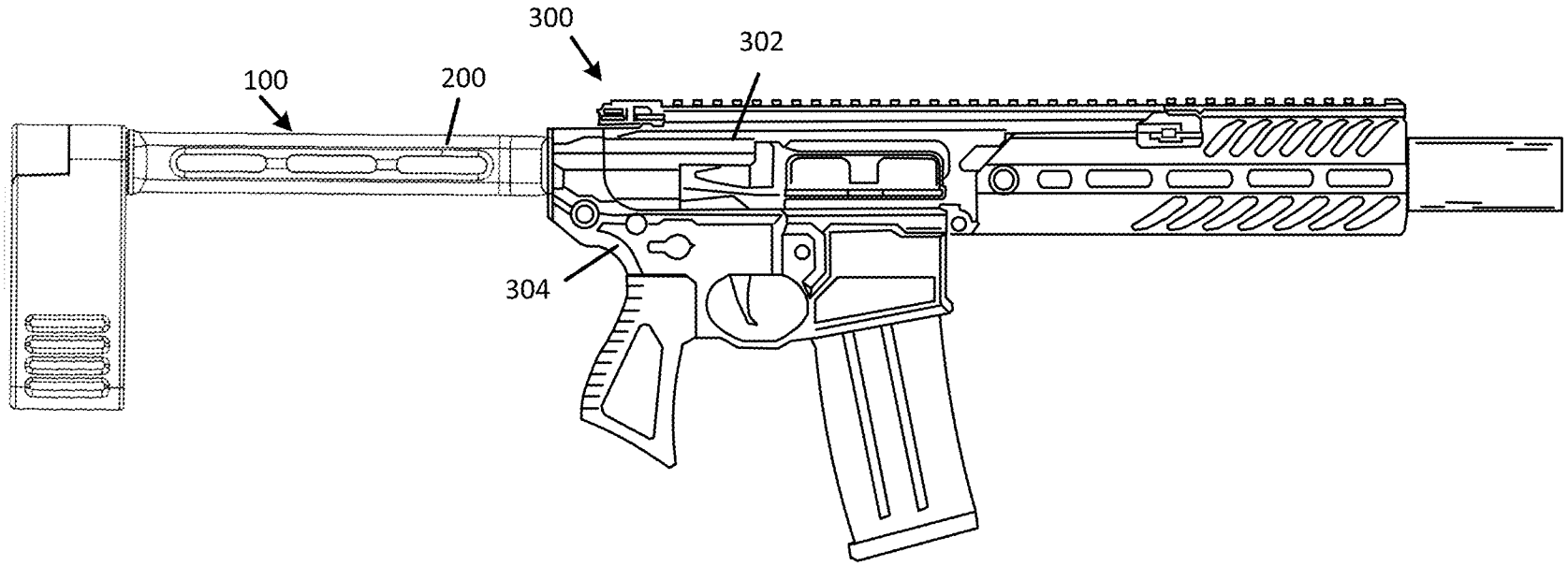
FIG. 22 illustrates a side view of a brace assembly with a longitudinal support attached to a firearm receiver, in accordance with another embodiment of the present disclosure.

FIG. 22 illustrates a side view of a brace assembly 100 installed on a firearm 300, in accordance with one embodiment. The brace assembly, components of which are shown in FIGS. 17-20, includes a longitudinal support 200 with integral mounting post 136. In this example, the firearm 300 is a pistol configured to fire rifle cartridges and includes an upper receiver 302 and a lower receiver 304. The longitudinal support 200 is a beam that is secured to the rear end of the lower receiver 304.

In use, embodiments of brace assembly 100 facilitate the user in supporting and using a pistol or other firearm 300, particularly those that are barrel-heavy. As variously described herein, the brace assembly 100 includes brace plates 180 that can be moved between an open position and a closed position. In the open position, the brace plates 180 and flexible strap 250 can be arranged to secure the firearm to the user's arm. Embodiments of brace assembly 100 advantageously enable the user to position the forearm for proper sight alignment when holding or shooting the firearm in various conventional shooting positions. Unlike prior-art braces, brace plates 180 can pivot independently about a common pivot axis, thereby allowing the user's forearm to move laterally away from median plane 15 of the pistol as needed. In addition to accommodating various shooting positions, the brace assembly 100 enables use by left-handed or right-handed shooters without the need to reconfigure the brace assembly 100.

A brace assembly 100 of the present disclosure can be used with pistols, submachine guns, carbines, and other suitable firearms. For example, some embodiments can be readily installed on a traditional buffer tube as found on M4-type rifles. In another example, the threaded end of the longitudinal support 200 screws into the back end of a firearm receiver. In yet another example, the longitudinal support 200 attaches to a hinge connector that engages the rear end of a firearm, such as clamping to rail made according to MIL-STD-1913 or the like. Numerous variations and embodiments will be apparent in light of the present disclosure.

FURTHER EXAMPLE EMBODIMENTS

The following examples pertain to further embodiments, from which numerous permutations and configurations will be apparent.

Example 1 is a brace assembly for use with a longitudinal support of a firearm. The assembly comprises a brace body with a first body member and a second body member. The first and second body members are configured to assemble together on opposite sides of the longitudinal support with the first body member engaging a first side of the longitudinal support and the second body member engaging an opposite second side of the longitudinal support. For example, the longitudinal support can include a cylindrical portion received between the first and second body members. Fasteners connect the first body member to the second body member, where tightening the one or more fasteners draws the first body member towards the second body member. A mounting post extends rearwardly from the brace body. A brace portion is mounted on the mounting post and is configured to engage a forearm of a user during use of the firearm.

Example 2 includes the subject matter of Example 1, wherein the brace portion includes a pair of brace plates each having an upper end portion defining an opening that receives the mounting post. Each of the brace plates can rotate independently about the mounting post between a first position and a second position.

Example 3 includes the subject matter of Example 2, and further comprises a key protruding from the mounting post. The opening in the upper end portion of each of the brace plates defines a corresponding keyway receiving the key such that the key and the corresponding keyway define a range of rotational movement for each of the brace plates between the first position and the second position.

Example 4 includes the subject matter of Example 2, wherein the first body member is a lower body member that defines a recess having a curved inside surface configured to receive and engage a bottom surface of the longitudinal support, and wherein the second body member is an upper body member configured to engage a top surface of the longitudinal support.

Example 5 includes the subject matter of any of Examples 1-3, wherein the first body member is a lower body member that defines a recess having a curved inside surface configured to receive and engage a bottom surface of the longitudinal support. The second body member is an upper body member configured to engage a top surface of the longitudinal support.

Example 6 includes the subject matter of Example 5, wherein the second body member includes a domed upper portion and side portions that extend downward and outward from the domed upper portion. The second body member further includes an L-shaped shelf extending inward from a bottom end of each side portion. The first body member includes sides that define a catch and a longitudinal channel adjacent the catch. When the first and second body members are assembled together, the catch and the longitudinal channel mate with the L-shaped shelf with part of the L-shaped shelf received in the longitudinal channel of the first body member.

Example 7 includes the subject matter of Example 4, wherein the recess further defines a channel intersecting the curved inside surface and extending down into the lower body member, wherein the recess and channel are configured to receive the longitudinal support having a cylindrical body and a flange on a bottom of the cylindrical body with the curved inside surface engaging the cylindrical body and with the flange occupying the channel.

Example 8 includes the subject matter of Example 7, wherein a bottom of the first body member defines a threaded fastener opening extending to the channel. The assembly further comprises a fastener configured to be installed in the threaded fastener opening, where the fastener can be advanced through the threaded fastener opening to engage the longitudinal support when the brace assembly is installed on the longitudinal support.

Example 9 includes the subject matter of any of Examples 1-8, wherein the mounting post is integrally formed as part of the first body member.

Example 10 includes the subject matter of any of Examples 1-9, and further comprises the longitudinal support, where the longitudinal support includes a cylindrical portion configured to be received between the first and second body members.

Example 11 is a brace assembly for use with a longitudinal support of a firearm, the longitudinal support extending rearwardly from the firearm along a central axis. The brace assembly comprises a clamping body that includes a lower body member and an upper body member. The lower body member defines a recess having an inside surface configured to receive a proximal end portion of the longitudinal support and to engage a bottom surface thereof. The lower body member also includes sides each having a first interlocking structure. The upper body member includes a domed middle portion and side portions that extend downward and outward from the domed middle portion. The domed middle portion is configured to engage a top surface of the longitudinal support, where each of the side portions includes a second interlocking structure. When the upper and lower body members are assembled together, the second interlocking structure of the upper body member mates with and engages the first interlocking structure of the lower body member. A mounting post extends rearwardly from the clamping body along the central axis. A forearm support is mounted on the mounting post, the forearm support configured to engage a forearm of a user during use of the firearm.

Example 12 includes the subject matter of Example 11, wherein the recess further defines a channel extending downward into the lower body member through the inside surface.

Example 13 includes the subject matter of Example 12, wherein lower body member defines a threaded fastener opening extending through a bottom surface to the channel, the assembly further comprising a fastener configured to be installed in the threaded fastener opening.

Example 14 includes the subject matter of Example 13, and further comprises a boss on an inside bottom surface of the channel. The threaded fastener opening extends through the boss.

Example 15 includes the subject matter of any of Examples 11-14, and further comprises fasteners connecting the upper body member to the lower body member, wherein when the fasteners are tightened, the upper and lower body members are drawn together.

Example 16 includes the subject matter of any of Examples 11-15, wherein the first interlocking structure comprises a recess and the second interlocking structure comprises protrusion constructed to be received in the recess.

Example 17 includes the subject matter of Example 16, wherein each of the side portions of the upper body member includes an L-shaped shelf extending inward from a bottom end of the side portion, the L-shaped shelf defining the protrusion.

Example 18 includes the subject matter of any of Examples 11, wherein the forearm support comprises a left brace member with a first upper end portion configured to attach to and pivot about the mounting post, and a right brace member with a second upper end portion configured to attach to and pivot about the mounting post. The left and right brace members extend down from the mounting post in opposed alignment and can pivot independently about the mounting post.

Example 19 is a firearm comprising the brace assembly of any of Examples 1-18 and the longitudinal support connected to and extending rearward from the firearm.

Example 20 includes the subject matter of Example 19, wherein the firearm is selected from a pistol, a short-barreled rifle, a submachine gun, and a carbine.

The foregoing description has been presented for the purposes of illustration and description. It is not intended to be exhaustive or to limit the present disclosure to the precise forms disclosed. Many modifications and variations are possible in light of this disclosure. It is intended that the scope of the present disclosure be limited not by this detailed description, but rather by the claims appended hereto. Future-filed applications claiming priority to this application may claim the disclosed subject matter in a different manner and generally may include any set of one or more limitations as variously disclosed or otherwise demonstrated herein.

We claim:

1. A brace assembly for use with a longitudinal support of a firearm that includes a cylindrical portion, the assembly comprising:

a brace body with a first body member and a second body member, the first and second body members configured to assemble together on opposite sides of the longitudinal support with the first body member engaging a first side of the longitudinal support and the second body member engaging an opposite second side of the longitudinal support;

one or more fasteners connecting the first body member to the second body member, wherein tightening the one or more fasteners draws the first body member towards the second body member;

a mounting post extending rearwardly from the brace body; and a brace portion mounted on the mounting post and configured to engage a forearm of a user during use of the firearm.

2. The brace assembly of claim 1, wherein the brace portion includes a pair of brace plates each having an upper end portion defining an opening that receives the mounting post, each of the brace plates independently rotatable about the mounting post between a first position and a second position.

3. The brace assembly of claim 2, further comprising a key protruding from the mounting post, wherein the opening in the upper end portion of each of the brace plates defines a corresponding keyway receiving the key such that the key and the corresponding keyway define a range of rotational movement for each of the brace plates between the first position and the second position.

4. The brace assembly of claim 2, further comprising a key protruding from an inside surface of the opening in the upper end portion of each of the brace plates, and wherein the mounting post defines a corresponding keyway receiving the key such that the key and the corresponding keyway define a range of rotational movement for each of the brace plates between the first position and the second position.

5. The brace assembly of claim 1, wherein the first body member is a lower body member that defines a recess having a curved inside surface configured to receive and engage a bottom surface of the longitudinal support, and wherein the second body member is an upper body member configured to engage a top surface of the longitudinal support.

6. The brace assembly of claim 4, wherein the second body member includes a domed upper portion and side portions that extend downward and outward from the domed upper portion;

the second body member further includes an L-shaped shelf extending inward from a bottom end of each side portion;

the first body member includes sides that define a catch and a longitudinal channel adjacent the catch; and when the first and second body portions are assembled together, the catch and the longitudinal channel mate with the L-shaped shelf with part of the L-shaped shelf received in the longitudinal channel of the first body member.

7. The brace assembly of claim 4, wherein the recess further defines a channel intersecting the curved inside surface and extending down into the lower body member, wherein the recess and channel are configured to receive the longitudinal support having a cylindrical body and a flange on a bottom of the cylindrical body with the curved inside surface engaging the cylindrical body and with the flange occupying the channel.

8. The brace assembly of claim 7, wherein a bottom of the first body member defines a threaded fastener opening extending to the channel, the assembly further comprising a fastener configured to be installed in the threaded fastener opening, wherein the fastener can be advanced through the threaded fastener opening to engage the longitudinal support when the brace assembly is installed on the longitudinal support.

9. The brace assembly of claim 1, wherein the mounting post is integrally formed as part of the first body member.

10. The brace assembly of claim 1, further comprising the longitudinal support, wherein the longitudinal support includes a cylindrical portion configured to be received between the first and second body members.

11. A brace assembly for use with a longitudinal support of a firearm, the longitudinal support extending rearwardly from the firearm along a central axis, the brace assembly comprising:

a clamping body comprising a lower body member defining a recess having an inside surface configured to receive a proximal end portion of the longitudinal support and to engage a bottom surface thereof, the lower body member including sides each having a first interlocking structure;

an upper body member including a domed middle portion and side portions that extend downward and outward from the domed middle portion, the domed middle portion configured to engage a top surface of the longitudinal support, wherein each of the side portions includes a second interlocking structure, wherein when assembled, the second interlocking structure of the upper body member mates with and engages the first interlocking structure of the lower body member;

a mounting post extending rearwardly from the clamping body along the central axis; and a forearm support on the mounting post, the forearm support configured to engage a forearm of a user during use of the firearm.

12. The brace assembly of claim 11, wherein the recess further defines a channel extending downward into the lower body member through the inside surface.

13. The brace assembly of claim 12, wherein lower body member defines a threaded fastener opening extending through a bottom surface to the channel, the assembly further comprising a fastener configured to be installed in the threaded fastener opening.

14. The brace assembly of claim 13, further comprising a boss on an inside bottom surface of the channel, wherein the threaded fastener opening extends through the boss.

15. The brace assembly of claim 11, further comprising fasteners connecting the upper body member to the lower body member, wherein when the fasteners are tightened, the upper and lower body members are drawn together.

16. The brace assembly of claim 11, wherein the first interlocking structure comprises a recess and the second interlocking structure comprises protrusion constructed to be received in the recess.

17. The brace assembly of claim 16, wherein each of the side portions of the upper body member includes an L-shaped shelf extending inward from a bottom end of the side portion, the L-shaped shelf defining the protrusion.

18. The brace assembly of claim 11, wherein the forearm support comprises:

a left brace member with a first upper end portion configured to attach to and pivot about the mounting post; and a right brace member with a second upper end portion configured to attach to and pivot about the mounting post;

wherein the left and right brace members extend down from the mounting post in opposed alignment and can pivot independently about the mounting post.

19. A firearm comprising:

the brace assembly of claim 11; and the longitudinal support connected to and extending rearward from the firearm.

20. The firearm of claim 19, wherein the firearm is selected from a pistol, a short-barreled rifle, a submachine gun, and a carbine.

* * * * *